US007824835B2

(12) United States Patent
Sugimoto et al.

(10) Patent No.: US 7,824,835 B2
(45) Date of Patent: Nov. 2, 2010

(54) TONER, PRODUCTION METHOD THEREOF, DEVELOPER, TONER CONTAINER, PROCESS CARTRIDGE, IMAGE FORMING METHOD, AND IMAGE FORMING APPARATUS

(75) Inventors: Tsuyoshi Sugimoto, Mishima (JP); Hiroshi Yamashita, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 345 days.

(21) Appl. No.: 11/854,842

(22) Filed: Sep. 13, 2007

(65) Prior Publication Data

US 2008/0070151 A1 Mar. 20, 2008

(30) Foreign Application Priority Data

Sep. 15, 2006 (JP) ..... 2006-251749

(51) Int. Cl.
*G03G 9/12* (2006.01)

(52) U.S. Cl. ..... 430/137.22; 430/109.1

(58) Field of Classification Search ..... 430/112, 430/137.22, 109.1
See application file for complete search history.

(56) References Cited

U.S. PATENT DOCUMENTS

| | | | |
|---|---|---|---|
| 4,996,127 | A | 2/1991 | Hasegawa et al. |
| 5,079,125 | A | 1/1992 | Anno et al. |
| 6,740,460 | B2 | 5/2004 | Tomita et al. |
| 6,787,280 | B2 | 9/2004 | Yamashita et al. |
| 6,846,604 | B2 | 1/2005 | Emoto et al. |
| 6,849,369 | B2 | 2/2005 | Yagi et al. |
| 6,946,229 | B2 | 9/2005 | Suzuki et al. |
| 7,074,535 | B2 | 7/2006 | Saito et al. |
| 7,074,541 | B2 | 7/2006 | Yamashita et al. |
| 7,198,874 | B2 | 4/2007 | Saito et al. |
| 7,241,548 | B2 | 7/2007 | Sugiyama et al. |
| 2003/0096185 | A1 | 5/2003 | Yamashita et al. |
| 2003/0219669 | A1 | 11/2003 | Yamashita et al. |
| 2004/0115551 | A1 | 6/2004 | Sugiyama et al. |
| 2004/0131961 | A1 | 7/2004 | Watanabe et al. |
| 2005/0079433 | A1 | 4/2005 | Watanabe et al. |
| 2006/0068312 | A1 | 3/2006 | Yamashita et al. |
| 2006/0127788 | A1 | 6/2006 | Yamashita et al. |
| 2006/0177756 | A1 | 8/2006 | Sugimoto et al. |
| 2006/0292482 | A1 | 12/2006 | Yamashita et al. |
| 2007/0015077 | A1* | 1/2007 | Yamashita et al. ..... 430/109.4 |
| 2007/0184370 | A1* | 8/2007 | Yamashita et al. ..... 430/45.1 |

FOREIGN PATENT DOCUMENTS

| | | |
|---|---|---|
| JP | 2537503 | 7/1996 |
| JP | 2794770 | 6/1998 |
| JP | 2001-22117 | 1/2001 |
| JP | 3640918 | 1/2005 |

OTHER PUBLICATIONS

U.S. Appl. No. 12/209,583, filed Sep. 12, 2008, Seshita, et al.
U.S. Appl. No. 12/248,313, filed Oct. 9, 2008, Sugimoto, et al.
U.S. Appl. No. 11/752,343, filed May 23, 2007, Tsuneyase Nagatomo, et al.

* cited by examiner

*Primary Examiner*—John L Goodrow
(74) *Attorney, Agent, or Firm*—Oblon, Spivak, McClelland, Maier & Neustadt, L.L.P.

(57) ABSTRACT

To provide a toner prepared by emulsifying or dispersing a solution or dispersion of a toner material in an aqueous medium containing fine resin particles for granulation, wherein at least one of the toner material and the aqueous medium contains a polyalkylene glycol ester compound that is compatible with the fine resin particles and that has a weight average molecular weight of 2,000 or greater.

15 Claims, 5 Drawing Sheets

TONER, PRODUCTION METHOD THEREOF, DEVELOPER, TONER CONTAINER, PROCESS CARTRIDGE, IMAGE FORMING METHOD, AND IMAGE FORMING APPARATUS

BACKGROUND OF THE INVENTION

1. Field of the Invention

The present invention relates to a toner for visualizing latent electrostatic images by electrophotography, electrostatic recording and electrostatic printing, and a production method thereof, and a developer, toner container, process cartridge, image forming method and image forming apparatus which use the toner.

2. Description of the Related Art

Conventionally, toner is used to visualize latent electric or magnetic images in electrophotography apparatus and electrostatic recording apparatus. For example, in electrophotography, a statically charged image (latent image) is formed on a photoconductor and the latent image is developed by toner to form a toner image. The toner image is generally transferred to a recording medium such as paper and then fixed thereto by heating. The toner used for developing the statically charged image generally consists of colored particles made of colorants, charge controlling agent and other additives which are contained in a binder resin. Toner production methods are broadly classified into pulverization and suspension polymerization methods.

In the pulverization method, a colorant, a charge controlling agent, and an anti-offset agent are melt-blended and uniformly dispersed in a thermoplastic resin and the obtained composition is pulverized and classified to produce a toner. The pulverization produces toners having more or less excellent properties. However, this method sets a limit on selection of toner materials. For example, the composition obtained by melt-blending should be pulverized and classified in an economically running apparatus. For this requirement, the melt-blended composition has to be sufficiently made fragile. Thus, the particles obtained by pulverizing the composition tend to have a broad particle size distribution. In order to obtain a copied image of high resolution and high level of gray scale, fine particles having a diameter of 5 μm or smaller and coarse particles having a diameter of 20 μm or larger have to be removed by classification, which however encounters a drawback of reduced toner yield. Furthermore, in the pulverization method, it is difficult to uniformly disperse a colorant and charge controlling agent in thermoplastic resin. Non-uniform dispersion of mixed components adversely affects the toner flowability, developing property, durability, and image quality.

Recently, in order to overcome the above problems in the pulverization method, a suspension polymerization method has been proposed and practiced for toner production. Techniques for producing toners for developing latent electrostatic images in polymerization are known. For example, suspension polymerization is used to obtain toner particles. However, the toner particles obtained in suspension polymerization are spherical in shape and poor in removability. Poor toner cleaning presents no problem in the development and transfer steps when image coverage is low, because a small amount of toner particles remain after transferred. However, where image coverage is high, e.g., images such as pictures, or where toner particles remain on the photoconductor due to unsuccessful toner transfer caused by paper feed failure, the accumulated toner particles lead to background smear of the image.

Furthermore, if the charging roller for contact-charging the photoconductor is contaminated, it becomes unable to exert its intrinsic charging ability. Then, a method has been proposed in which fine resin particles are obtained by emulsion polymerization and associated to produce toner particles that are irregular in shape (see Japanese Patent (JP-B) No. 2537503). However, the toner particles obtained by emulsion polymerization have a large amount of surfactant remains not only on the surface but also inside thereof, thereby impairing the toner's charge stability against the environment, broadening the charge amount distribution, and leading to high levels of background smear. The residual surfactant further contaminates the photoconductor, charging roller, developing roller, etc., and thus these members fail to exert their intrinsic charging ability.

As for the fixing system in the electrophotography, a heating roller fixing system is widely used for its high energy efficiency and in view of device miniaturization, in which system a heating roller that is excellent in heat efficiency is directly pressed against a toner image on the recording medium for fixing. Considering the environment-friendly policy including energy-saving, lower power consumption is desired for the heating roller in the fixing step.

In attempts to resolve the above problem, fixing units have been improved and rollers have a reduced thickness on the side in contact with the toner image carrier surface for further increased heat energy efficiency, realizing a significant reduction in start-up time. However, the reduced specific heat capacity has caused difference in temperature between the area where the recording medium passes through and the area where the recording medium does not. Then, a so-called hot offset phenomenon occurs in which toner melts and adheres to the fixing roller and, after one rotation of the fixing roller, this toner is fixed to non-image areas on a recording medium. Therefore, there is an increasing demand for hot offset resistant toner.

Recently, the heat energy applied to the toner during the fixing tends to be reduced such as in the low-temperature fixing for energy-saving and high speed copy operation.

The toner used in the low-temperature fixing generally uses low-softening point resins or waxes for improved low-temperature fixing property. The low-temperature fixing toner, which is vulnerable to heat, is known to undergo so-called blocking—a phenomenon where toner particles solidify—due to heat generated from the machine and during storage. It is difficult to ensure a sufficient range of low-fixing temperature. Even with the use of polyester resin that is said to have relatively good heat storage stability in spite of its good low-temperature fixing property, no toner that resolves the above problems has been provided.

In order to satisfy the above conflicting properties, a method of producing a toner having a multilayer structure in which the particles have inner and outer resins having different compositions has been proposed. In this method, the particles have a resin having a low glass-transition temperature for improved low-temperature fixing in their interior and a resin having a high glass-transition temperature for required heat-resistance/storage stability on the surface. In this way, a toner having excellent fixing property is provided.

Proposed methods of producing a multilayer structure toner include in situ polymerization, interfacial polymerization, coacervation, spray-drying, and phase transfer emulsification. A method of producing a toner in the phase transfer emulsification has been proposed in which the toner has a multilayer structure and fine particles having a high glass-transition temperature are fixed on the toner surface for improved heat-resistance/storage stability (Japanese Patent Application Laid-Open (JP-A) No. 2001-022117). This technique allows the multilayer structure toner to have improved heat-resistance/storage stability. However, this technique does not always yield a toner with a sufficient range of fixing temperatures. Particularly, it fails to ensure the offset resistance while keeping the fixing start temperature low.

Among attempts to produce a multilayer structure toner, a toner production method has been proposed in which the particles have resins different in molecular weight between the inner and outer layers (Japanese Patent (JP-B) No. 2794770). In this method, the particles have a resin having a low molecular weight in the interior and a resin having a molecular weight higher than the interior resin on the surface, thereby providing a highly durable toner. This toner has improved durability; however, the toner does not have a sufficient range of fixing temperatures because the surface is uniformly covered with a high molecular weight substance. Particularly, it fails to ensure both the lower fixing start temperature and the offset resistance.

A toner for developing statically charged images has been proposed (Japanese Patent (JP-B) No. 3640918) that is obtained by dissolving or dispersing toner components including a toner binder consisting of a modified polyester resin reactive with active hydrogen in an organic solvent to form a solution or dispersion, reacting the solution or dispersion with a crosslinker or extension agent in an aqueous medium containing fine resin particles that may form an aqueous dispersion, removing the solvent from the obtained dispersion, and washing away the fine resin particles attached to the toner surface, wherein the residual rate of the fine resin particles remaining on the toner particle surface is 2.5% by mass or lower based on the toner particles as measured by pyrolysis gas chromatography (mass spectrometry).

By covering with fine resin particles the surface of a toner made of polyester resin having excellent low-temperature fixing property, the toner offers excellent low-temperature fixing property and heat resistance/storage stability. The toner further has a narrow particle distribution because the fine resin particles serve as a dispersion stabilizer during toner preparation. Therefore, a toner that offers excellent image quality can be obtained. However, again, such a toner does not sufficiently exert a low-temperature fixing property intrinsic to the polyester resin due to the presence of the high molecular weight fine resin particles attached to the toner surface. When the fine resin particles are used in smaller amounts, the particle size distribution of the toner may be broadened.

BRIEF SUMMARY OF THE INVENTION

An object of the present invention is to provide a toner that is usable with the low-temperature fixing system, excellent in the offset resistance, does not cause smear on the fixing apparatus and images, has a narrow particle distribution and small particle size and a sharp electrification distribution, and forms sharp visible images over a prolonged period of time and a production method thereof, and a developer, toner container, a process cartridge, image forming method, and image forming apparatus using the toner.

As a result of keen examination of the present inventors for overcoming the problems, they established that a toner prepared by emulsifying or dispersing a solution or dispersion of toner material in an aqueous medium containing fine resin particles for granulation wherein at least one of the toner material and the aqueous medium contains a polyalkylene glycol ester compound that is compatible with the resin particles and that has a weight average molecular weight of 2,000 or higher has reduced adverse affect of the fine resin particles attached to the toner surface on the fixing property, because the fine resin particles are swelled by the polyalkylene glycol ester compound. At the same time, it was established that the fine resin particles sufficiently serve as a dispersion stabilizer; therefore, the particles have small particle sizes and a narrow particle size distribution, realizing a toner that is capable of formation sharp images over a prolonged period of time.

The present invention is made based on the above findings of the inventors and the means for resolving the above problems are as follows.

<1> A toner prepared by emulsifying or dispersing a solution or dispersion of a toner material in an aqueous medium containing fine resin particles for granulation, wherein at least one of the toner material and the aqueous medium contains a polyalkylene glycol ester compound that is compatible with the fine resin particles and that has a weight average molecular weight of 2,000 or greater.

<2> The toner according to <1>, wherein the aqueous medium contains a polyalkylene glycol ester compound that is compatible with the fine resin particles and that has a weight average molecular weight of 2,000 or greater.

<3> The toner according to one of <1> and <2>, wherein the solution or dispersion of the toner material contains an organic solvent, and the organic solvent is removed during or after the granulation.

<4> The toner according to any one of <1> to <3>, wherein the toner material contains an active hydrogen group-containing compound and a polymer reactive with the active hydrogen group-containing compound, and wherein the granulation is conducted by reacting the active hydrogen group-containing compound with the polymer in the aqueous medium to produce an adhesive base, to obtain particles of the adhesive base.

<5> The toner according to any one of <1> to <4>, wherein the polyalkylene glycol ester compound is an esterified product of a carboxylic acid having the following General Formula (1) and a polyalkylene glycol having the following General Formula (2):

$$R—COOH \qquad \text{<General Formula (1)>}$$

where R is an alkyl group having 10 or more carbon atoms; and $$HO—[(CH_2)_n—O]_m—OH \qquad \text{<General formula (2)>}$$

where n and m each represent an integer of 2 or greater.

<6> The toner according to any one of <1> to <5>, wherein the content of the polyalkylene glycol ester compound is 5% by mass or higher based on the total mass of the toner.

<7> The toner according to any one of <1> to <6>, wherein the polyalkylene glycol ester compound has a melting point of 40° C. or higher.

<8> The toner according to any one of <1> to <7>, wherein the fine resin particles have a volume average particle diameter of 5 nm to 500 nm.

<9> The toner according to any one of <1> to <8>, wherein the content of the fine resin particles in the toner is 0.5% by mass or higher.

<10> The toner according to any one of <1> to <9>, wherein the toner material contains a wax, and the wax contains a hydrocarbon wax having a melting point of 50° C. or higher.

<11> The toner according to any one of <1> to <10>, wherein the toner has a glass transition temperature (Tg) of 50° C. to 80° C.

<12> The toner according to any one of <1> to <11>, wherein the toner has a volume average particle size (Dv) of 3 μm to 8 μm, and the ratio of the volume average particle diameter (Dv) to the number average particle diameter (Dn), (Dv/Dn), is 1.00 to 1.25.

<13> A method for producing a toner, including: dissolving or dispersing a toner material to prepare a solution or dispersion of the toner material; and emulsifying or dispersing the solution or dispersion of the toner material in an aqueous medium containing fine resin particles for granulation, wherein at least one of the toner material and the aqueous medium contains a polyalkylene glycol ester compound that is compatible with the fine resin particles and that has a weight average molecular weight of 2,000 or higher.

<14> The method according to <13>, wherein the solution or dispersion of the toner material contains an organic solvent, and the organic solvent is removed during or after the granulation.

<15> The method according to one of <13> and <14>, wherein the toner material contains an active hydrogen group-containing compound and a polymer reactive with the active hydrogen group-containing compound, and wherein the granulation is conducted by reacting the active hydrogen group-containing compound with the polymer in the aqueous medium to produce an adhesive base, to obtain particles of the adhesive base.

<16> A developer including the toner according to any one of <1> to <12>.

<17> A toner container including the toner according to any one of <1> to <12>.

<18> A process cartridge including a latent electrostatic image bearing member, and a developing unit configured to develop a latent electrostatic image on the latent electrostatic image bearing member using the toner according to any one of <1> to <12> to form a visible image, wherein the process cartridge is detachably mounted to an image forming apparatus body.

<19> An image forming method including: forming a latent electrostatic image on a latent electrostatic image bearing member; developing the latent electrostatic image using the toner according to any one of <1> to <12> to form a visible image; transferring the visible image onto a recording medium; and fixing a transferred image transferred on the recording medium.

<20> An imaging forming apparatus including: a latent electrostatic image bearing member; a latent electrostatic image forming unit configured to form a latent electrostatic image on the latent electrostatic image bearing member; a developing unit configured to develop the latent electrostatic image using the toner according to any one of <1> to <12> to form a visible image; a transfer unit configured to transfer the visible image onto a recording medium; and a fixing unit configured to fix a transferred image transferred on the recording medium.

The toner of the present invention is a toner prepared by emulsifying or dispersing a solution or dispersion of toner materials in an aqueous medium containing fine resin particles for granulation, wherein at least one of the toner materials and the aqueous medium contains a polyalkylene glycol ester compound which is compatible with the fine resin particles and which has a weight average molecular weight of 2,000 or higher.

In the toner of the present invention, the fine resin particles are swelled by the polyalkylene glycol ester compound, whereby adverse affects of the fine resin particles attached to the toner surface on the fixing property, particularly on the lower fixing limit, can be reduced. Furthermore, the fine resin particles sufficiently serve as a dispersion stabilizer, realizing small particle sizes and a narrow particle distribution, whereby high quality sharp images can be formed over a prolonged period of time.

The toner production method of the present invention is a toner production method in which a solution or dispersion of toner material is emulsified or dispersed in an aqueous medium containing fine resin particles for granulation wherein at least one of the toner material and the aqueous medium contains a polyalkylene glycol ester compound which is compatible with the fine resin particles and which has a weight average molecular weight of 2,000 or higher. In the toner of the present invention, the fine resin particles are swelled by the polyalkylene glycol ester compound, whereby adverse affects of the fine resin particles adhere to the toner surface on the fixing property, particularly on lowest fixing temperature, can be reduced.

The developer of the present invention contains the toner of the present invention. Therefore, when the developer is used to form images in the electrophotography, high quality sharp images can be formed over a prolonged period of time.

The toner container used in the present invention is a container storing therein the toner of the present invention. Therefore, when the toner contained in the toner container is used to form images by electrophotography, high quality sharp images can be formed over a prolonged period of time.

The process cartridge used in the present invention includes at least a latent electrostatic image bearing member and a developing unit configured to develop a latent electrostatic image on the latent electrostatic image bearing member using the toner of the present invention to form a visible image. The process cartridge is detachably mounted on an image forming apparatus, which is highly convenient. Using the toner of the present invention, high quality sharp images can be formed over a prolonged period of time.

The image forming method used in the present invention includes at least a latent electrostatic image forming step of forming a latent electrostatic image on a latent electrostatic image bearing member, a developing step of developing the latent electrostatic image using the toner of the present invention to form a visible image, a transfer step of transferring the visible image onto a recording medium, and a fixing step of fixing a transferred image transferred to the recording medium. In the image forming method of the present invention, a latent electrostatic image is formed on the latent electrostatic image bearing member in a latent electrostatic image forming step. The latent electrostatic image is developed using the toner of the present invention to form a visible image in the developing step. The visible image is transferred onto a recording medium in the transfer step. The transferred image transferred to the recording medium is fixed in the fixing step. Consequently, high quality and high image density sharp images can be obtained.

The imaging forming apparatus used in the present invention includes at least a latent electrostatic image bearing member, a latent electrostatic image forming unit configured to form a latent electrostatic image on the latent electrostatic image bearing member, a developing unit configured to develop the latent electrostatic image using the toner of the present invention to form a visible image, a transfer unit configured to transfer the visible image onto a recording medium, and a fixing unit configured to fix a transferred image transferred to the recording medium. In the image forming apparatus, the latent electrostatic image forming unit forms a latent electrostatic image on the latent electrostatic image bearing member. The developing unit develops the latent electrostatic image using the toner of the present invention to form a visible image. The transfer unit transfers the visible image onto a recording medium. The fixing unit fixes the transferred image transferred to the recording medium. Consequently, high quality electrophotographic images can be formed.

Figure 1:
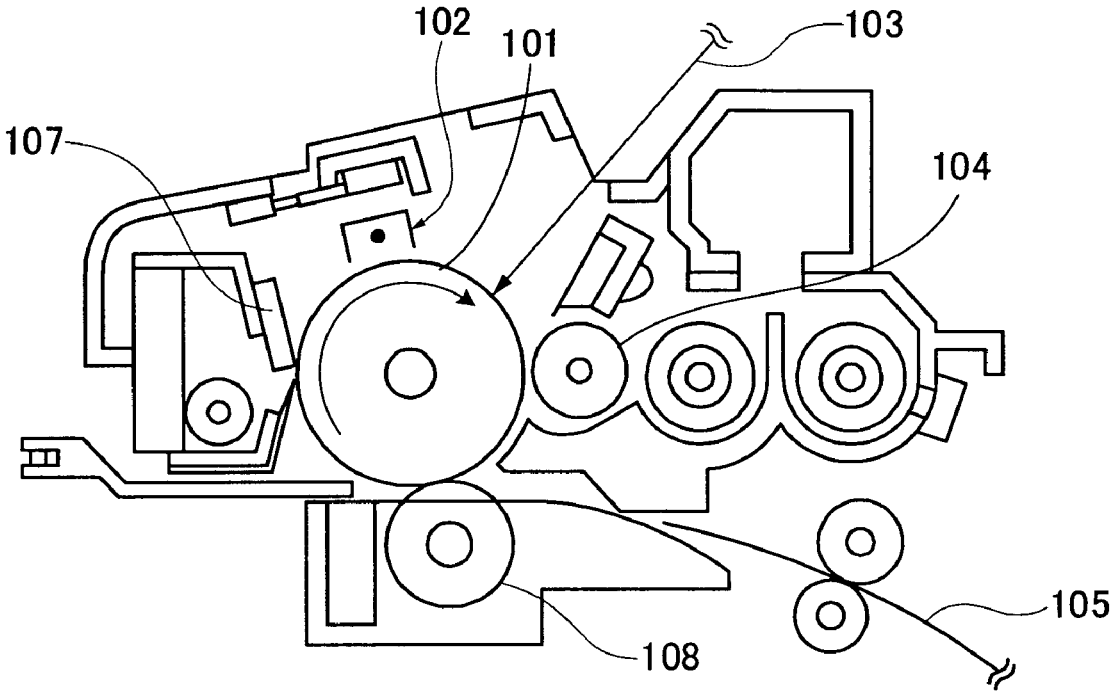
FIG. 1 is a schematic illustration showing an example of a process cartridge used in the present invention.

DETAILED DESCRIPTION OF THE INVENTION (Toner and Toner Production Method)

The toner of the present invention is prepared by emulsifying or dispersing a solution or dispersion of toner materials in an aqueous medium containing fine resin particles for granulation, wherein at least one of the toner materials or the aqueous medium contains a polyalkylene glycol ester compound which is compatible with the fine resin particles and which has a weight average molecular weight of 2,000 or higher (occasionally this ester compound is referred to as "PAG ester" hereafter).

The toner production method of the present invention includes emulsifying or dispersing of a solution or dispersion of toner materials in an aqueous medium containing fine resin particles for granulation, wherein at least one of the toner materials or the aqueous medium contains a polyalkylene glycol ester compound which is compatible with the fine resin particles and which has a weight average molecular weight of 2,000 or higher.

The toner and toner production method of the present invention will be described in detail hereafter.

-Polyalkylene Glycol Ester Compound-

The polyalkylene glycol ester compound is not particularly restricted and can appropriately be selected according to the purpose as long as it is compatible with the fine resin particles and has a weight average molecular weight of 2,000 or higher. However, the polyalkylene glycol ester compound is preferably an esterified product between at least one carboxylic acid having the following General Formula (1) and a polyalkylene glycol having the General Formula (2) below.

$$R—COOH \qquad \text{<General formula (1)>}$$

where R is an alkyl group having 10 or more carbon atoms, preferably 10 to 24 carbon atoms, and more preferably 16 to 24 carbon atoms.

When the above R is an alkyl group having 10 or more carbon atoms, the polyalkylene glycol ester compound is properly surface-active, and acts on the fine resin particles present on the toner surface.

The carboxylic acid having the above General Formula (1) is preferably a linear, branched, or cyclic aliphatic saturated carboxylic acid; examples thereof include lauric acid, palmitic acid, stearic acid, and behenic acid.

$$HO—[(CH_2)_n—O]_m—OH \qquad \text{<General Formula (2)>}$$

wherein n and m each represent an integer of 2 or greater.

The above n is preferably 2 or higher, more preferably 2 or 3, and further preferably 2. Polyethylene glycol (PEG) having n=2 has a proper polarity to act on the fine resin particles present in the interface and more easily yields PAG esters having higher melting points than other polyalkylene glycols.

The above m is determined according to the weight average molecular weight of the polyalkylene glycol ester compound, and preferably is an integer of 2 or greater, more preferably 10 or greater, and further preferably 30 to 100.

The polyalkylene glycol ester compound is required to have a weight average molecular weight of 2,000 or higher, preferably 3,000 or higher, and more preferably 4,000 to 40,000. The weight average molecular weight of 2,000 or higher is appropriate for the surfactant to act on the toner surface, whereby the fine resin particles attached to the toner surface are effectively swelled, realizing a sufficient low-temperature fixing property.

Here, the weight average molecular weight can be measured for example by gel permeation chromatography (GPC).

The melting point of the polyalkylene glycol ester compound is preferably 40° C. or higher and more preferably 50° C. to 80° C. When the melting point is lower than 40° C., the heat-resistance/storage stability may be reduced. When the melting point is higher than 80° C., it may result in failure to obtain low-temperature fixing property.

Here, the melting point of the polyalkylene glycol ester compound can be measured for example by a DSC system (differential scanning calorimeter)

The polyalkylene glycol ester compound can be obtained by esterifying a carboxylic acid having the above General Formula (1) and a polyalkylene glycol having the above General Formula (2) through dehydration condensation in the presence or absence of a solvent using a known acid or alkali catalyst.

The added amount of the polyalkylene glycol ester compound is preferably 5% by mass or higher, more preferably 5% by mass to 20% by mass, and further preferably 7% by mass to 15% by mass based on the total mass of the toner components. When the mixing rate is lower than 5% by mass, only a small amount of polyalkylene glycol ester compound compatible with the polyester resin is available upon fixing, whereby the low-temperature fixing property may be deteriorated. When the mixing rate is higher than 20% by mass, the toner productivity may be lowered.

The total mass of the toner components means the total solid contents throughout the toner production process, i.e., the total of solid contents of toner materials, fine resin particles, polyalkylene glycol ester compound, and other component(s).

-Fine Resin Particles-

The fine resin particles are not particularly restricted and can appropriately be selected among known resins according to the purpose as long as they are compatible with the polyalkylene glycol ester compound. The fine resin particles can be made of thermoplastic resin or heat-curable resin, such as vinyl resin, polyurethane resin, epoxy resin, polyester resin, polyamide resin, polyimide resin, silicon resin, phenol resin, melamine resin, urea resin, aniline resin, ionomer resin, and polycarbonate resin. They can be used singly or in combination. Among them, the resin particles are preferably formed by at least one selected from vinyl resin, polyurethane resin, epoxy resin, and polyester resin because an aqueous dispersion of fine spherical resin particles can easily be obtained.

The vinyl resin is a homopolymer or copolymer of vinyl monomers such as styrene-(meth)acrylic acid ester resin, styrene-butadiene copolymers, (meth)acrylic acid-acrylic acid ester polymers, styrene-acrylonitrile copolymers, styrene-maleic anhydride copolymers, and styrene-(meth)acrylic acid copolymers.

The fine resin particles can be a copolymer containing a monomer having at least two unsaturated groups.

The monomer having at least two unsaturated groups is not particularly restricted and can appropriately be selected according to the purpose, such as methacrylic acid ethylene oxide adduct sulfuric acid ester sodium salts ("Eleminol RS-30," manufactured by Sanyo Chemical Industries), divinyl benzene, and 1,6-hexanediol acrylate.

The fine resin particles can be obtained by polymerization using a known technique selected according to the purpose. They are preferably obtained as an aqueous solution of fine resin particles. For example, an aqueous solution of the rein fine particles can preferably be prepared in the following manners: (1) for the vinyl resin, directly preparing an aqueous dispersion of the fine resin particles by polymerization selected from suspension polymerization, emulsion polymerization, seed polymerization, and dispersion polymerization using vinyl monomers as the starting material; (2) for the polyaddition or condensation resin such as the polyester resin, polyurethane resin, and epoxy resin, dispersing precursors (monomers, oligomers, etc.) or their solution in a solvent in an aqueous medium in the present of an appropriate dispersant, curing it by heating or with the addition of a curing agent to form aqueous dispersing elements of the fine resin particles; (3) for the polyaddition or condensation resin such as the polyester resin, polyurethane resin, and epoxy resin, dissolving an appropriate emulsifier in precursors (monomers, oligomers, etc.) or their solution in a solvent (which is preferably a liquid form or can be liquefied by heating), phase-transfer emulsifying it with the addition of water; (4) pulverizing the resin previously prepared by polymerization (any polymerization such as addition polymerization, ring-opening polymerization, polyaddition, addition condensation, and condensation polymerization) in a mechanical rotating-type or jet-type pulverizer, classifying them to obtain fine resin particles, and dispersing them in water in the presence of an appropriate dispersant; (5) dissolving in a solvent the resin previously prepared by polymerization (any polymerization such as addition polymerization, ring-opening polymerization, polyaddition, addition condensation, and condensation polymerization) to form a resin solution, nebulizing the resin solution to obtain fine resin particles, and dispersing the resin particles in water in the presence of an appropriate dispersant; (6) adding a poor solvent to a resin solution of the resin previously prepared by polymerization (any polymerization such as addition polymerization, ring-opening polymerization, polyaddition, addition condensation, and condensation polymerization) in an solvent or cooling a resin solution prepared by heat-dissolving the resin in a solvent so as to separate the fine resin particles, removing the solvent to obtain the fine resin particles, dispersing the resin particles in water in the presence of an appropriate dispersant; (7) dispersing in an aqueous medium a resin solution of the resin previously prepared by polymerization (any polymerization such as addition polymerization, ring-opening polymerization, polyaddition, addition condensation, and condensation polymerization) in a solvent in the presence of an appropriate dispersant and removing the solvent by heating or under reduced pressure; and (8) dissolving an appropriate emulsifier in a resin solution of the resin previously prepared by polymerization (any polymerization such as addition polymerization, ring-opening polymerization, polyaddition, addition condensation, and condensation polymerization) in a solvent and phase-transfer emulsifying it with the addition of water.

The volume average particle size of the fine resin particles is preferably 5 nm to 500 nm and more preferably 10 nm to 100 nm. When the volume average particle size is smaller than 5 nm, the resin has a small molecular weight and the heat-resistance/storage stability may be reduced. When the volume average particle size is larger than 500 nm, they do not adhere to the toner surface and may not serve as dispersion stabilizing particles.

The volume average particle size of the fine resin particles can be measured with a laser scattering device (for example, LA-920 manufactured by Horiba Seisakujo), dynamic light scattering device (for example, Microtrac UPA manufactured by Nikkiso), or electric field release scanning electron microscope (for example, S-4200 manufactured by Hitachi Seisakusho).

The content of the fine resin particles in the toner is preferably 0.5% by mass or higher, and more preferably 1.0% by mass to 5.0% by mass. When the content of the fine resin particles is within these ranges, the fine resin particles exhibit excellent dispersion stabilizing effect during the granulation, yielding an excellent particle size distribution. When the content is lower than 0.5% by mass, it is not sufficient for the fine resin particles to act as a dispersion stabilizer. Therefore, the fine resin particles do not exhibit sufficient dispersion stabilizing effect and the toner may have a poor particle size distribution.

The content of the fine resin particles in the toner can be determined by analyzing the substances originating from the fine resin particles, not from the toner particles, by a pyrolysis chromatography mass spectrometer for calculating the content based on the peak area. A preferable detector is a mass spectrometer.

The fine resin particles serve as a dispersion stabilizer when dispersing the dispersion or solution of toner components in an aqueous medium, advantageously contributing to small particle sizes and a narrow particle size distribution.

-Determination of Compatibility Between PAG Ester and Fine Resin Particles-

That the fine resin particles and PAG ester are compatible with each other means that, when they are mixed and heated, values for such thermal properties as glass transition temperature, melting point, softening point based on the flow tester property, T ½ method temperature, and/or melting viscosity of one or both of the fine resin particles and PAG ester are lower than the value measured for the fine resin particles or PAG ester alone. Thus, when any of the measurements for these physical properties is reduced, it can be determined that the PAG ester and fine resin particles are compatible.

Compatibility is determined based on any of the above properties. For example, the following methods (1) and (2) can be used.

(1) Fine resin particles and PAG ester are mixed at proportions of 1:1 on a mass basis, pounded in a mortar, and screened by a mesh of 100 μm in aperture to prepare a mixture of PAG ester and fine resin particles.

The obtained PAG ester/fine resin particles mixture and the PAG ester by itself are check for compatibility by a DSC system (differential scanning calorimeter) ("DSC-60," manufactured by Shimadzu Seisakusho) in the manner described below.

First, approximately 5.0 mg of PAG ester is placed in an aluminum sample container. The sample container is placed on a holder unit and mounted in an electric furnace. The sample is heated from 20° C. to 150° C. at a temperature increase rate of 10° C./min in a nitrogen atmosphere. Then, the sample is cooled to 0° C. at a temperature decrease rate of 10° C./min. Then, the sample is again heated to 150° C. at a temperature increase rate of 10° C./min and the DSC curve is measured. The melting point Tm1 of the PAG ester is calculated from the DSC curve obtained during the second temperature increase using the analysis program in the DSC-60 system based on the peak value derived from the PAG ester. Subsequently, the same measurement is obtained for the PAG ester/fine resin particles mixture. Here, it is assumed that the peak for the PAG ester in the mixture during the second temperature increase is Tm2. When the relationship Tm1−Tm2>1 (° C.) is established, it is determined that they are compatible with each other because the PAG ester and resin particles were mutually dissolved during the first temperature increase and thus the melting point was lowered.

(2) Compatibility is determined based on changes in the glass transition temperature of the fine resin particles by the addition of PAG ester.

First, approximately 5.0 mg of the fine resin particles are placed in an aluminum container. The sample container is placed on a holder unit and mounted in an electric furnace. The sample is heated from 20° C. to 150° C. at a temperature increase rate of 10° C./min in a nitrogen atmosphere. Then, the sample is cooled to 0° C. at a temperature decrease rate of 10° C./min. Then, the sample is again heated to 150° C. at a temperature increase rate of 10° C./min and the DSC curve is measured. The glass transition temperature Tg1 is obtained from the DSC curve obtained during the second temperature increase using the analysis program in the DSC-60 system based on the endothermic curve derived from the resin particles.

Subsequently, the same measurement is obtained for the PAG ester/fine resin particles mixture. Here, it is assumed that the endothermic curve from the resin particles in the mixture after the second temperature increase is Tg2. When the relationship Tg1−Tg2>5 (° C.) is established, it is determined that they are compatible with each other because the PAG ester was compatible with the resin particles during the first temperature increase and thus the melting point was lowered.

The toner of the present invention is, as described above, prepared by emulsifying or dispersing a solution or dispersion of toner materials in an aqueous medium for granulation.

The solution of the toner materials is prepared by dissolving the toner materials in a solvent. The dispersion of the toner materials is prepared by dispersing them in a solvent.

The toner materials are not particularly restricted and can appropriately be selected according to the purpose as long as they can form a toner. The toner material contains at least, for example, any one of monomer, polymer, active hydrogen group-containing compound and a polymer reactive with the active hydrogen group-containing compound and, where necessary, further contain other component(s) such as a colorant, releasing agent (wax), and/or charge controlling agent.

At least one of the toner materials or the aqueous medium can contain the PAG ester. However, it is preferable that the aqueous medium contain the PAG ester because the effect of the PAG ester is not affected by materials in the oil phase (such as releasing agent, colorant (pigment), charge controlling agent) and is directed to the resin particles.

It is preferable that the solution or dispersion of toner materials contain an organic solvent. In other words, it is preferable that the toner materials be dissolved or dispersed in an organic solvent to prepare a solution or dispersion thereof.

When an organic solvent is contained, it is preferable that the organic solvent be removed during or after the granulation step.

The organic solvent is not particularly restricted and can appropriately be selected according to the purpose as long as they can dissolve or disperse the toner materials. Volatile solvents having a boiling point of lower than 150° C. are preferable because of easy removal, including toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. Among them, toluene, xylene, benzene, methylene chloride, 1,2-dichloroethane, chloroform, and carbon tetrachloride are preferable and ethyl acetate is particularly preferable. They can be used singly or in combination.

The added amount of the organic solvent is not particularly restricted and can appropriately be selected according to the purpose. For example, the usage is preferably 40 parts by mass to 300 parts by mass, more preferably 60 parts by mass to 140 parts by mass, and further preferably 80 parts by mass to 120 parts by mass, per 100 parts by mass of the toner materials.

-Aqueous Medium-

The aqueous medium is not particularly restricted and can appropriately be selected from known aqueous media. Examples of the aqueous medium include water, solvents miscible with water, and their mixture. Among them, water is particularly preferable.

The solvents miscible with water are not particularly restricted as long as they are miscible with water. Examples of the solvents miscible with water include alcohol, dimethyl formamide, tetrahydrofuran, cellusolves, and lower ketones.

Examples of the alcohol include methanol, isopropanol, and ethyleneglycol. Examples of the lower ketones include acetone and methyl ethyl ketone.

They can be used singly or in combination.

-Emulsification or Dispersion-

It is preferable that the solution or dispersion of toner materials be emulsified or dispersed in the aqueous medium while the solution or dispersion is stirred in the aqueous medium.

The dispersion method is not particularly restricted and can appropriately be selected using a known disperser. Examples of the disperser include low speed shear disperser, high speed shear disperser, friction disperser, high pressure jet disperser, and ultrasonic disperser. Among them, the high speed shear disperser is preferable because the particle size of the dispersing elements (oil droplets) can be controlled for 2 μm to 20 μm.

When the high speed shear disperser is used, conditions such as the rotation speed, dispersion time, and dispersion temperature are not particularly restricted and can appropriately be selected according to the purpose. For example, the rotation speed is preferably 1,000 rpm to 30,000 rpm and more preferably 5,000 rpm to 20,000 rpm. The dispersion time is preferably 0.1 min to 5 min in a batch system. The dispersion temperature is preferably 0° C. to 150° C. and more preferably 40° C. to 98° C. under pressure. In general, the dispersion is easily done at higher dispersion temperatures.

-Granulation-

The granulation method is not particularly restricted and can appropriately be selected from known techniques. The toner is granulated for example by suspension polymerization, emulsion polymerization aggregation, or solution/suspension or by producing an adhesive base described later and obtaining particles with the adhesive base. Among them, the method of producing an adhesive base described later and obtaining particles with the adhesive base is preferable.

In the method of producing the adhesive base for granulating a toner, the toner materials include an active hydrogen group-containing compound and a polymer reactive with the active hydrogen group-containing compound and the granulation is conducted by reacting in an aqueous medium the active hydrogen group-containing compound with the polymer reactive with the active hydrogen group-containing compound to produce an adhesive base and obtaining particles with the adhesive base.

The toner formed by the above granulation method contains the adhesive base and, where necessary, further contains other appropriately selected component(s) such as a colorant, releasing agent, and/or charge controlling agent.

-Adhesive Base-

The adhesive base exhibits adhesion to recording media such as paper. The adhesive base contains at least an adhesive polymer obtained by reacting an active hydrogen group-containing compound with a polymer reactive with the active hydrogen group-containing compound in an aqueous medium and may further contain a binder resin appropriately selected from known binder resins.

The weight average molecular weight of the adhesive base is not particularly restricted and can appropriately be selected according to the purpose. For example, the weight average molecular weight is preferably 3,000 or higher, more preferably 5,000 to 1,000,000, and further preferably 7,000 to 500,000. When the weight average molecular weight is lower than 3,000, the hot offset resistance may be reduced.

The glass transition temperature (Tg) of the adhesive base is not particularly restricted and can appropriately be selected according to the purpose. For example, it is preferably 30° C. to 70° C. and more preferably 40° C. to 65° C. Both crosslinked and extended polyester resins are present in the toner. Therefore, excellent storage stability is ensured in spite of low glass-transition temperatures compared to the conventional polyester toner.

When the glass transition temperature (Tg) is lower than 30° C., the toner may have deteriorated heat-resistance/storage stability. When the glass-transition temperature (Tg) is higher than 70° C., sufficient low-temperature fixing property may not be obtained.

The glass transition temperature can be measured for example by a TG-DSC system TAS-100 (manufactured by Rigaku Denki) as follows. First, approximately 10 mg of the toner is introduced in an aluminum sample container. The sample container is placed on a holder unit and mounted in an electric furnace. The sample is heated from room temperature to 150° C. at a temperature increase rate of 10° C./min. The sample is allowed to stand at 150° C. for 10 min, cooled to room temperature, and allowed to stand for 10 min. Then, the sample is heated to 150° C. at a temperature increase rate of 10° C./min in a nitrogen atmosphere. The DSC curve is obtained using a differential scanning calorimeter (DSC). The glass transition temperature (Tg) can be calculated from the obtained DSC curve using the analysis system in the TG-DSC system TAS-100 system based on the contact point of the tangent of the endothermic curve in the vicinity of the glass-transition temperature (Tg) with the baseline.

The adhesive base is not particularly restricted and can appropriately be selected according to the purpose. For example, polyester resin is particularly preferable.

The polyester resin is not particularly restricted and can appropriately be selected according to the purpose. For example, urea-modified polyester resin is particularly preferable.

The urea-modified polyester resin is obtained by reacting an amine (B) as the active hydrogen group-containing compound with an isocyanate group-containing polyester prepolymer (A) as the polymer reactive with the active hydrogen group-containing compound in the aqueous medium.

The urea-modified polyester resin can contain the urethane bond in addition to the urea bond. In such a case, the molar content ratio of the urea bond to the urethane bond (the urea bond/the urethane bond) is not particularly restricted and can appropriately be selected according to the purpose. The ratio is preferably 100/0 to 10/90, more preferably 80/20 to 20/80, and particularly preferably 60/40 to 30/70. When the urea bond is less than 10, the hot offset resistance may be deteriorated.

Preferable specific examples of the urea-modified polyester resin include the following (1) to (10):(1) a mixture of a polyester prepolymer obtained by reacting a polycondensation product of bisphenol A ethylene oxide 2-mole adduct and isophthalic acid with isophorone diisocyanate and further treated with isophorone diamine to produce an urea compound and a polycondensation product of bisphenol A ethylene oxide 2-mole adduct and isophthalic acid; (2) a mixture of a polyester prepolymer obtained by reacting a polycondensation product of bisphenol A ethylene oxide 2-mole adduct and isophthalic acid with isophorone diisocyanate and further treated with isophorone diamine to produce an urea compound and a polycondensation product of bisphenol A ethylene oxide 2-mole adduct and terephthalic acid; (3) a mixture of a polyester prepolymer obtained by reacting a polycondensation product of bisphenol A ethylene oxide 2-mole adduct/bisphenol A propylene oxide 2-mole adduct and terephthalic acid with isophorone diisocyanate and further treated with isophorone diamine to produce an urea compound and a polycondensation product of bisphenol A ethylene oxide 2-mole adduct/bisphenol A propylene oxide 2-mole adduct and terephthalic acid; (4) a mixture of a polyester prepolymer obtained by reacting a polycondensation product of bisphenol A ethylene oxide 2-mole adduct/bisphenol A propylene oxide 2-mole adduct and terephthalic acid with isophorone diisocyanate and further treated with isophorone diamine to produce an urea compound and a polycondensation product of bisphenol A propylene oxide 2-mole adduct and terephthalic acid; (5) mixtures of a polyester prepolymer obtained by reacting a polycondensation product of bisphenol A ethylene oxide 2-mole adduct and terephthalic acid with isophorone diisocyanate and further treated with hexamethylene diamine to produce an urea compound and a polycondensation product of bisphenol A ethylene oxide 2-mole adduct and terephthalic acid; (6) a mixture of a polyester prepolymer obtained by reacting a polycondensation product of bisphenol A ethylene oxide 2-mole adduct and terephthalic acid with isophorone diisocyanate and further treated with hexamethylene diamine to produce an urea compound and a polycondensation product of bisphenol A ethylene oxide 2-mole adduct/bisphenol A propylene oxide 2-mole adduct and terephthalic acid; (7) a mixture of a polyester prepolymer obtained by reacting a polycondensation product of bisphenol A ethylene oxide 2-mole adduct and terephthalic acid with isophorone diisocyanate and further treated with ethylene diamine to produce an urea compound and a polycondensation product of bisphenol A ethylene oxide 2-mole adduct and terephthalic acid; (8) a mixture of a polyester prepolymer obtained by reacting a polycondensation product of bisphenol A ethylene oxide 2-mole adduct and isophthalic acid with diphenyl methane diisocyanate and further treated with hexamethylene diamine to produce an urea compound and a polycondensation product of bisphenol A ethylene oxide 2-mole adduct and isophthalic acid; (9) a mixture of a polyester prepolymer obtained by reacting a polycondensation product of bisphenol A ethylene oxide 2-mole adduct/bisphenol A propylene oxide 2-mole adduct and terephthalic acid/dodecenylsuccinic anhydride with diphenyl methane diisocyanate and further treated with hexamethylenediamine to produce an urea compound and a polycondensation product of bisphenol A ethylene oxide 2-mole adduct/bisphenol A propylene oxide 2-mole adduct and terephthalic acid; and (10) a mixture of a polyester prepolymer obtained by reacting a polycondensation product of bisphenol A ethylene oxide 2-mole adduct and isophthalic acid with toluene diisocyanate and further treated with hexamethylenediamine to produce an urea compound and a polycondensation product of bisphenol A ethylene oxide 2-mole adduct and isophthalic acid.

-Active Hydrogen Group-Containing Compound-

The active hydrogen group-containing compound serves as extender and crosslinker for the polymer reactive with the active hydrogen group-containing compound to extend and crosslink in the aqueous medium.

The active hydrogen group-containing compound is not particularly restricted and can appropriately be selected according to the purpose as long as they have active hydrogen groups. For example, when the polymer reactive with the active hydrogen group-containing compound is the isocyanate group-containing polyester prepolymer (A), the amine (B) is preferable because the extension and crosslinking reaction with the isocyanate group-containing polyester prepolymer (A) yields high molecular weights.

The active hydrogen group is not particularly restricted and can appropriately be selected according to the purpose. Examples of the active hydrogen group include hydroxyl (alcohol hydroxyl or phenol hydroxyl), amino, carboxyl, and mercapto groups. They can be used singly or in combination. Among them, the alcohol hydroxyl group is particularly preferable.

The amine (B) is not particularly restricted and can appropriately be selected according to the purpose. Examples of the amine (B) include diamine (B1), trivalent or higher polyamine (B2), aminoalcohol (B3), aminomercaptan (B4), amino acid (B5), and the foregoing (B1) to (B5) in which amino groups are blocked (B6).

They can be used singly or in combination of two or more. Among them, diamine (B1) and mixtures of diamine (B1) and a small amount of trivalent or higher polyamine (B2) are particularly preferable.

Examples of the diamine (B1) include aromatic diamine, alicyclic diamine, and aliphatic diamine. Examples of the aromatic diamine include phenylene diamine, diethyl toluene diamine, and 4,4'-diaminodiphenyl methane. Examples of the alicyclic diamine include 4,4'-diamino-3,3'-dimethyldicyclohexylmethane, diamine cyclohexane, and isophorone diamine. Examples of the aliphatic diamine include ethylenediamine, tetramethylene diamine, and hexamethylenediamine.

Examples of the trivalent or higher polyamine (B2) include diethylenetriamine and triethylenetetramine.

Examples of the aminoalcohol (B3) include ethanolamine and hydroxy ethyl aniline.

Examples of the aminomercaptan (B4) include aminoethylmercaptan and aminopropylmercaptan.

Examples of the amino acid (B5) include aminopropionic acid and aminocaproic acid.

Examples of the foregoing (B1) to (B5) in which amino groups are blocked (B6) include ketimine compounds and oxazoline compounds obtained from any of the amines of the above (B1) to (B5) and ketones (such as acetone, methyl ethyl ketone, methyl isobutyl ketone).

A reaction terminator can be used to terminate the extension and crosslinking reaction between the active hydrogen group-containing compound and the polymer reactive with the active hydrogen group-containing compound. It is preferable to use a reaction terminator because the molecular weight of the adhesive base can be controlled for a desired range. Examples of the reaction terminator include monoamines (such as diethylamine, dibutylamine, butylamine, and laurylamine) and blocked compounds thereof (ketimine compounds).

The mixing ratio of the amine (B) and the isocyanate group-containing polyester prepolymer (A) is preferably determined so that the equivalent weight ratio ([NCO]/[NHx]) of isocyanate group [NCO] in the isocyanate group-containing prepolymer (A) to amino group [NHx] in the amine (B) is preferably 1/3 to 3/1, more preferably 1/2 to 2/1, and particularly preferably 1/1.5 to 1.5/1.

When the equivalent weight ratio ([NCO]/[NHx]) is smaller than 1/3, the low-temperature fixing property may be deteriorated. When it is higher than 3/1, the urea-modified polyester resin has a low molecular weight and the hot offset resistance may be deteriorated.

-Polymer Reactive with Active Hydrogen Group-Containing Compound-

The polymer reactive with the active hydrogen group-containing compound (occasionally termed "prepolymer" hereafter) is not particularly restricted and can appropriately be selected among known resins as long as they have a site reactive with the active hydrogen group-containing compound; examples thereof include polyol resins, polyacrylic resins, polyester resins, epoxy resins, and derivatives thereof. They can be used singly or in combination. Among them, polyester resins are particularly preferable in view of their high flowability upon melted and transparency.

The site of the prepolymer that is reactive with the active hydrogen group-containing compound is not particularly restricted and can appropriately be selected from known substituents, including isocyanate group, epoxy group, carboxylic acid, and acid chloride group. They can be contained singly or in combination. Among them, isocyanate group is particularly preferable.

Among the above prepolymers, urea bond-generating group-containing polyester resin (RMPE) is particularly preferable because of easily controlled molecular weights and excellent oil-less low-temperature fixing property of the dry toner, particularly excellent release and fixing properties where no mechanism for applying releasing oil to the heating medium for fixing is provided.

Examples of the urea bond-generating group include isocyanate group. When the urea bond-generating group of the urea bond-generating group-containing polyester resin (RMPE) is isocyanate groups, it is particularly preferable that the polyester resin (RMPE) is isocyanate group-containing polyester prepolymer (A).

The isocyanate group-containing polyester prepolymer (A) is not particularly restricted and can appropriately be selected according to the purpose, including polycondensation products of a polyol (PO) and a polycarboxylic acid (PC) that is produced by reacting the active hydrogen group-containing polyester resin with polyisocyanate (PIC).

The polyol (PO) is not particularly restricted and can appropriately be selected according to the purpose. Examples of the polyol (PO) include diols (DIO), trivalent or higher polyols (TO), and mixtures of a diol (DIO) and a trivalent or higher polyol (TO). They can be used singly or in combination. Among them, diols (DIO) by themselves or mixtures of a diol (DIO) and a small amount of a trivalent or higher polyol (TO) are preferable.

Examples of the diols (DIO) include alkylene glycol, alkylene ether glycol, alicyclic diol, alicyclic diol alkylene oxide adducts, bisphenols, and alkylene oxide adducts of bisphenols.

The alkylene glycol preferably has 2 to 12 carbon atoms. Their examples include ethyleneglycol, 1,2-propylene glycol, 1,3-propylene glycol, 1,4-butanediol, and 1,6-hexanediol. Examples of the alkylene ether glycol include diethylene glycol, triethylene glycol, dipropylene glycol, polyethylene glycol, polypropylene glycol, and polytetramethylene ether glycol. Examples of the alicyclic diol include 1,4-cyclohexanedimethanol and hydrogenated bisphenol A. Examples of the alkylene oxide adducts of alicyclic diol include the alicyclic diol with the addition of alkylene oxide such as ethylene oxide, and propylene oxide, and butylene oxide. Examples of the bisphenol include bisphenol A, bisphenol F, and bisphenol S. Examples of the alkylene oxide adducts of the bisphenols include the bisphenols with the addition of alkylene oxide such as ethylene oxide, propylene oxide, and butylene oxide.

Among them, alkylene glycols having 2 to 12 carbon atoms and alkylene oxide adducts of bisphenols are preferable. alkylene oxide adducts of bisphenols and mixtures of alkylene oxide adducts of bisphenols and alkylene glycol having 2 to 12 carbon atoms are particularly preferable.

The trivalent or higher polyols (TO) preferably have a valency of 3 to 8 or higher. Their examples include trivalent or higher polyvalent aliphatic alcohol, trivalent or higher polyphenols, and alkylene oxide adducts of trivalent or higher polyphenols.

Examples of the trivalent or higher multivalent aliphatic alcohols include glycerine, trimethylolethane, trimethylolpropane, pentaerythritol, and sorbitol. Examples of the trivalent or higher polyphenols include trisphenol PA, phenol novolac, and cresol novolac. Examples of the alkylene oxide adducts of trivalent or higher polyphenols include trivalent or higher polyphenols with the addition of alkylene oxide such as ethylene oxide, propylene oxide, and butylene oxide.

The mixing mass ratio (DIO:TO) of the diol (DIO) to the trivalent or higher polyol (TO) in the mixture of the diol (DIO) and the trivalent or higher polyol (TO) is preferably 100:0.01 to 10 and more preferably 100:0.01 to 1.

The polycarboxylic acid (PC) is not particularly restricted and can appropriately be selected according to the purpose. Examples of the polycarboxylic acid (PC) include dicarboxylic acid (DIC), trivalent or higher polycarboxylic acid (TC), and mixtures of dicarboxylic acid (DIC) and trivalent or higher polycarboxylic acid.

They can be used singly or in combination. Among them, dicarboxylic acid (DIC) by itself or mixtures of DIC and a small amount of trivalent or higher polycarboxylic acid (TC) are preferable.

Examples of the dicarboxylic acid include alkylene dicarboxylic acids, alkenylene dicarboxylic acids, and aromatic dicarboxylic acids.

Examples of the alkylene dicarboxylic acid include succinic acid, adipic acid, and sebacic acid. The alkenylene dicarboxylic acid is preferably those having 4 to 20 carbon atoms, including maleic acid and fumaric acid. The aromatic dicarboxylic acid is preferably those having 8 to 20 carbon atoms, including phthalic acid, isophthalic acid, terephthalic acid, and naphthalenedicarboxylic acid.

Among them, alkenylenedicarboxylic acids having 4 to 20 carbon atoms and aromatic dicarboxylic acids having 8 to 20 carbon atoms are preferable.

The trivalent or higher polycarboxylic acid (TO) is preferably those having 3 to 8 or more carboxylic groups, including aromatic polycarboxylic acids.

The aromatic polycarboxylic acid is preferably those having 9 to 20 carbon atoms, including trimellitic acid and pyromellitic acid.

The polycarboxylic acid (PC) can be an acid anhydride or lower alkyl ester selected from the above described dicarboxylic acid (DIC), trivalent or higher polycarboxylic acid (TC), and mixtures of the dicarboxylic acid (DIC) and trivalent or higher polycarboxylic acid. Examples of the lower alkyl ester include methyl ester, ethyl ester, and isopropyl ester.

The mixing mass ratio (DIC:TC) of the dicarboxylic acid (DIC) to the trivalent or higher polycarboxylic acid (TC) in the mixture of the dicarboxylic acid (DIC) and trivalent or higher polycarboxylic acid (TC) is not particularly restricted and can appropriately be selected according to the purpose. For example, the ratio is preferably 100:0.01 to 10 and more preferably 100:0.01 to 1.

The mixing ratio of the polyol (PO) to the polycarboxylic acid (PC) upon polycondensation is not particularly restricted and can appropriately be selected according to the purpose. For example, in general, the equivalent weight ratio ([OH]/[COOH]) of hydroxyl group [OH] in the polyol (PO) to carboxyl group [COOH] in the polycarboxylic acid (PC) is preferably 2/1 to 1/1, more preferably 1.5/1 to 1/1, and particularly preferably 1.3/1 to 1.02/1.

The content of the isocyanate group-containing polyester prepolymer (A) in the polyol (PO) is not particularly restricted and can appropriately be selected according to the purpose. For example, the content is preferably 0.5% by mass to 40% by mass, more preferably 1% by mass to 30% by mass, and particularly preferably 2% by mass to 20% by mass. When the content is lower than 0.5% by mass, the hot offset resistance may be reduced and it is difficult to ensure that the toner has both heat-resistance/storage stability and the low-temperature fixing property. When the content is higher than 40% by mass, the low-temperature fixing property may be deteriorated.

The polyisocyanate (PIC) is not particularly restricted and can appropriately be selected according to the purpose. Examples of the polyisocyanate (PIC) include aliphatic polyisocyanate, alicyclic polyisocyanate, aromatic diisocyanate, aromatic-aliphatic diisocyanate, isocyanurates, their phenol derivatives, and their blocks with oxime and caprolactam.

Examples of the aliphatic polyisocyanate include tetramethylene diisocyanate, hexamethylenediisocyanate, 2,6-diisocyanate methyl caproate, octamethylene diisocyanate, decamethylene diisocyanate, dodecamethylene diisocyanate, tetradecamethylene diisocyanate, trimethyl hexanediisocyanate, and tetramethyl hexanediisocyanate. Examples of the alicyclic polyisocyanate include isophorone diisocyanate and cyclohexylmethanediisocyanate. Examples of the aromatic diisocyanate include tolylenediisocyanate, diphenyl methanediisocyanate, 1,5-naphthylenediisocyanate, diphenylene-4,4'-diisocyanate, 4,4'-diisocyanato-3,3'-dimethyl diphenyl, 3-methyl diphenyl methane-4,4'-diisocyanate, and diphenyl ether-4,4'-diisocyanate. Examples of the aromatic-aliphatic diisocyanate include $\alpha,\alpha,\alpha',\alpha'$-tetramethyl xylylenediisocyanate. Examples of the isocyanurates include tris-isocyanate alkyl-isocyanurate, and triisocyanatocycloalkyl-isocyanurate. They can be used singly or in combination.

The mixing ratio of the polyisocyanate (PIC) and the active hydrogen group-containing polyester resin (such as a hydroxyl group-containing polyester resin) upon reaction is such that the mixing equivalent weight ratio ([NCO]/[OH]) of the isocyanate group [NCO] in the polyisocyanate (PIC) to the hydroxyl group [OH] in the hydroxyl group-containing polyester resin is preferably 5/1 to 1/1, more preferably 4/1 to 1.2/1, and particularly preferably 3/1 to 1.5/1.

When the isocyanate group [NCO] exceeds 5, the low-temperature fixing property may be deteriorated. When the isocyanate group [NCO] is less than 1, the offset resistance may be deteriorated.

The content of the polyisocyanate (PIC) in the isocyanate group-containing polyester prepolymer (A) is not particularly restricted and can appropriately be selected according to the purpose. The content is preferably 0.5% by mass to 40% by mass, more preferably 1% by mass to 30% by mass, and further preferably 2% by mass to 20% by mass.

When the content is lower than 0.5% by mass, the hot offset resistance may be reduced and it is difficult to ensure both heat-resistance/storage stability and the low-temperature fixing property. When the content is higher than 40% by mass, the low-temperature fixing property may be deteriorated.

The average number of isocyanate groups per molecule of the isocyanate group-containing polyester prepolymer (A) is preferably 1 or more, more preferably 1.2 to 5, and further preferably 1.5 to 4.

When the average number of isocyanate groups is smaller than 1, the urea bond generating group-modified polyester resin (RMPE) has a low molecular weight and the hot offset resistance may be reduced.

The weight-average molecular weight (Mw) of the polymer reactive with the active hydrogen group-containing compound is preferably 1,000 to 30,000 and more preferably 1,500 to 15,000 as determined from the molecular weight distribution of tetrahydrofuran (THF)-dissolved contents obtained by GPC (gel-permeation chromatography). When the weight-average molecular weight (Mw) is lower than 1,000, the heat-resistance/storage stability may be deteriorated. When the weight-average molecular weight (Mw) is higher than 30,000, the low-temperature fixing property may be deteriorated.

The molecular weight distribution can be measured by the above mentioned gel permeation chromatography (GPC) as follows.

First, a column is equilibrated in a heat chamber at 40° C. At this temperature, tetrahydrofuran (THF) as a column solvent is passed through the column at a flow rate of 1 ml/min. Then, 50-200 μl of a resin sample solution in tetrahydrofuran whose concentration is adjusted to 0.05% by mass to 0.6% by mass is introduced. For obtaining the molecular weight of the sample, the molecular weight distribution is calculated based on the logarithm value of an analytical curve created by several monodispersive polystyrene standard samples and the counts. The standard polystyrene samples for creating the analytical curve can be those having a molecular weight of $6\times10^2$, $2.1\times10^2$, $4\times10^2$, $1.75\times10^4$, $1.1\times10^5$, $3.9\times10^5$, $8.6\times10^5$, $2\times10^6$ and $4.48\times10^6$ ex. Pressure Chemical Co. or Toyo Soda. It is preferable that at least 10 standard polystyrene samples are used. The detector can be an RI (refractive index) detector.

-Binder Resin-

The binder resin is not particularly restricted and can appropriately be selected according to the purpose. Examples of the binder resing include polyester resin. Particularly, unmodifided polyester resin (polyester resin that is not modified) is preferable.

When the toner contains an unmodifided polyester resin, the low-temperature fixing property and glossiness are improved.

Examples of the unmodified polyester resin include those similar to the urea bond generating group-containing polyester resin, in other words polycondensation products of polyol (PO) and polycarboxylic acid (PC). Considering the low-temperature fixing property and hot offset resistance, it is preferable that the unmodified polyester resin is partly compatible with the urea bond generating group-containing polyester resin (RMPE), in other words they have compatible, similar structures.

The weight-average molecular weight (Mw) of the unmodified polyester resin is preferably 1,000 to 30,000 and more preferably 1,500 to 15,000 as determined from the molecular weight distribution of tetrahydrofuran (THF)-dissolved contents obtained by GPC. When the weight-average molecular weight (Mw) is lower than 1,000, the heat-resistance/storage stability may be deteriorated. Therefore, the content of those having weight-average molecular weight (Mw) of lower than 1,000 is preferably 8% by mass to 28% by mass. On the other hand, when the weight-average molecular weight (Mw) is higher than 30,000, the low-temperature fixing property may be deteriorated.

The glass transition temperature of the unmodified polyester resin is preferably 30° C. to 70° C., more preferably 35° C. to 60° C., and further preferably 35° C. to 50° C. When the glass transition temperature is lower than 30° C., the toner heat-resistance/storage stability may be deteriorated. When it is higher than 70° C., the low-temperature fixing property may not be sufficient.

The unmodified polyester resin preferably has a hydroxyl group number of 5 mg KOH/g or higher, more preferably 10 mg KOH/g to 120 mg KOH/g, and further preferably 20 mg KOH/g to 80 mg KOH/g. When the hydroxyl group number is lower than 5 mg KOH/g, it is difficult to ensure both the heat-resistance/storage stability and the low-temperature fixing property.

The unmodified polyester resin preferably has an acid number of 1.0 mg KOH/g to 50.0 mg KOH/g and more preferably 1.0 mg KOH/g to 30.0 mg KOH/g. In general, having an acid number, the toner is easily negatively charged.

When the toner contains the unmodified polyester resin, the mixing mass ratio (RMPE/PE) of the urea bond generating group-containing polyester resin (RMPE) to the unmodified polyester resin (PE) is preferably 5/95 to 25/75 and more preferably 10/90 to 25/75. When the mixing mass ratio is higher than 95, the hot offset resistance may be deteriorated. When it is lower than 75, the low-temperature fixing property and image glossiness may be deteriorated.

-Other Components-

Other components are not particularly restricted and can appropriately be selected according to the purpose. Examples of other components include colorants, releasing agents, charge controlling agents, inorganic fine particles, flow improvers, cleaning property improvers, magnetic materials, and metal soaps.

The colorant is not particularly restricted and can appropriately be selected from known dyes and pigments according to the purpose. Examples of the colorant include carbon black, nigrosine dyes, iron black, naphthol yellow S, Hansa yellow (10G, 5G, G), cadmium yellow, yellow iron oxide, yellow ocher, yellow lead, titanium yellow, polyazo yellow, oil yellow, Hansa yellow (GR, A, RN, R), pigment yellow L, benzidine yellow (G, GR), permanent yellow (NCG), vulcan fast yellow (5G, R), tartrazine lake, quinoline yellow lake, antheragen yellow BGL, isoindolynone yellow, red iron oxide, red lead, vermilion lead, cadmium red, cadmium mercury red, antimony vermilion, permanent red 4R, para red, fire red, parachlororthonitro aniline red, lithol fast Scarlet G, brilliant fast scarlet, brilliant carmine BS, permanent red (F2R, F4R, FRL, FRLL, F4RH), fast scarlet VD, vulcan fast rubin B, brilliant scarlet G, lithol rubin GX, Permanent Red F5R, brilliant carmine 6B, pigment scarlet 3B, Bordeaux 5B, toluidine maroon, permanent Bordeaux F2K, helio Bordeaux BL, Bordeaux 10B, BON maroon light, BON maroon medium, eosine lake, rhodamine lake B, rhodamine lake Y, alizarine lake, thioindigo red B, thioindigo maroon, oil red, quinacridone red, pyrazolone red, polyazo red, chrome vermilion, benzidine orange, perynone orange, oil orange, cobalt blue, cerulean blue, alkali blue lake, peacock blue lake, Victoria blue lake, metal-free phthalocyanine blue, phtalocyanine blue, fast sky blue, indanthrene blue (RS, BC), indigo, ultramarine, Prussian blue, anthraquinone blue, fast violet B, methyl violet lake, cobalt purple, manganese purple, dioxane violet, anthraquinone violet, chrome green, zinc green, chrome oxide, pyridian, emerald green, pigment green B, naphthol green B, green gold, acid green lake, malachite green lake, phthalocyanine green, anthraquinone green, titanium oxide, zinc white, lithopone, and their mixtures. They can be used singly or in combination.

Examples of colorants preferably used include pigment red such as PR 122, PR 269, PR 184, PR 57:1, PR 238, PR 146, PR 185; pigment yellow such as PY 93, PY 128, PY 155, PY 180, PY 74; and pigment blue such as PB 15:3.

The colorant can be used as a colorant dispersion in which only a colorant is previously dispersed in the solvent or can directly be dispersed in the solvent together with the binder resin and adhesive base. Even when the colorant is previously dispersed, the binder resin and adhesive base can partly added to adjust the viscosity so that a proper shear force is generated during pigment dispersion.

After the colorant is dispersed, the colorant in the colorant dispersion preferably have a particle size of, for example, 1 μm or smaller. When the particle size is larger than 1 μm, the colorant in the final toner is large in particle size and the image quality may be deteriorated. Particularly, an OHP sheet may offer reduced light transmissivity.

The particle size of colorant can be measured by a laser diffraction/scattering particle size distribution analyzer using the laser beam scattering technique ("LA-920" manufactured by Horiba Seisakujo).

The content of colorant in the toner is not particularly restricted and can appropriately be set to a desired level according to the purpose. The content is preferably 1% by mass to 15% by mass and more preferably 3% by mass to 10% by mass. When the content is lower than 1% by mass, the toner offers poor coloring ability. When the content is higher than 15% by mass, the pigment particles are not dispersed well in the toner, sometimes reducing the coloring ability and electric properties of the toner.

The releasing agent is not particularly restricted and can appropriately be selected from known agents according to the purpose. For example, waxes are preferable.

Examples of the waxes include hydrocarbon waxes and carbonyl group-containing waxes. Among them, hydrocarbon waxes are particularly preferable. Using hydrocarbon waxes leads to a large difference in polarity between the wax and PAG ester. Because of low degree of interaction between them, the low-temperature fixing property of the PAG ester and the release property of the wax do not interfere with each other; then, both properties are well exhibited.

Examples of the hydrocarbon waxes include polyethylene wax, polypropylene wax, paraffin wax, and sazol wax.

Examples of the carbonyl group-containing waxes include polyalkanoic acid ester, polyalkanol ester, polyalkanoic acid amide, polyalkyl amide, and dialkyl ketone. Examples of the polyalkanoic acid ester include carnauba wax, montan wax, trimethylolpropane tribehenate, pentaerythritol tetrabehenate, pentaerythritol diacetate dibehenate, glycerine tribehenate, and 1,18-octadecanediol distearate. Examples of the polyalkanol ester include trimellitic acid tristearyl and distearyl maleate. Examples of the polyalkanoic acid amide include dibehenylamide. Examples of the polyalkyl amide include trimellitic acid tristearyl amide. Examples of the dialkyl ketone include distearyl ketone.

The melting point of the releasing agent is not particularly restricted and can appropriately be set to a desired level according to the purpose. The melting point is preferably 50° C. or higher, more preferably 50° C. to 160° C., and further preferably 50° C. to 120° C. When the melting point is lower than 50° C., the wax may adversely affect the heat-resistance/storage stability. When the melting point is higher than 160° C., the cold offset tends to occur during the low-temperature fixing.

The melting viscosity of the releasing agent is preferably 5 cps to 1,000 cps and more preferably, 10 cps to 100 cps when measured at a temperature higher than the melting point of the wax by 20° C.

When the melting viscosity is lower than 5 cps, the releasing property may be deteriorated. When the melting viscosity is higher than 1,000 cps, improvement in the hot offset resistance and low-temperature fixing property may not be observed.

The content of releasing agent in the toner is not particularly restricted and can appropriately be selected according to the purpose. The content is preferably 0% by mass to 40% by mass and more preferably 3% by mass to 30% by mass. When the content is higher than 40% by mass, the toner may offer poor flowability.

The charge controlling agent is not particularly restricted and can appropriately be selected from known agents according to the purpose. Colored agents may change the color tone. Therefore, colorless or nearly white materials are preferable, such as triphenyl methane dyes, molybdic acid chelate pigments, rhodamine dyes, alkoxyamine, quaternary ammonium salts (including fluorine-modified quaternary ammonium salts), alkyl amide, phosphorous by itself or its compounds, tungsten by itself or compounds thereof, fluorinated surfactants, salicylic acid metal salts, and metal salts of salicylic acid derivatives. They can be used singly or in combination.

The charge controlling agent can be commercially available products such as Bontron P-51 (quaternary ammonium salt), E-82 (oxynaphthoic acid metal complex), E-84 (salicylic acid metal complex), E-89 (phenol condensate) (ex. Orient Chemicals); TP-302 and TP-415 (quaternary ammonium salt molybdenum complexes) (ex. Hoya Chemicals); Copy Charge PSY VP2038 (quaternary ammonium salt), Copy Blue PR (triphenylmethane derivative), Copy Charge NEG VP2036 and Copy Charge NX VP434 (quaternary ammonium salts) (manufactured by Hext); LRA-901 and LR-147 (boron complex) (manufactured by Nippon Cartridge); quinacridone, azo pigments, other polymer compounds having sulfonic group, carboxyl group, or quaternary ammonium salts.

The charge controlling agent is melted and kneaded with the master batch and then dissolved and dispersed. Alternatively, the charge controlling agent can be directly dissolved or dispersed in the organic solvent together with the toner components or attached to the toner surface after the toner particles are produced.

The content of charge controlling agent in the toner varies depending on the type of the binder resin, the present or absence of additives, and dispersion method and cannot uniquely be determined. For example, the content is preferably 0.1 parts by mass to 10 parts by mass and more preferably 0.2 parts by mass to 5 parts by mass per 100 parts by mass of the binder resin. When the content is lower than 0.1 parts by mass, the charge control property may not be obtained. When the content is higher than 10 parts by mass, the toner is excessively charged. Then, the primary charge control effect is impaired and the electrostatic attraction between the toner and the developing roller is increased, whereby the flowability of the developer and the image density may be reduced.

The inorganic fine particles are not particularly restricted and can appropriately be selected from known fine particles according to the purpose; examples thereof include silica, alumina, titanium oxide, barium titanate, magnesium titanate, calcium titanate, strontium titanate, zinc oxide, tin oxide, silica sand, clay, mica, sand lime brick, diatom earth, chromium oxide, ceria, red iron oxide, antimony trioxide, magnesium oxide, zirconium oxide, barium sulfate, barium carbonate, calcium carbonate, silicon carbide, and silicon nitride. They can be used singly or in combination.

The primary particle size of the inorganic fine particles is preferably 5 nm to 2 μm and more preferably 5 nm to 500 nm. The specific surface area of the inorganic fine particles measured by the BET method is preferably 20 $m^2/g$ to 500 $m^2/g$.

The content of inorganic fine particles in the toner is preferably 0.01% by mass to 5.0% by mass and more preferably 0.01% by mass to 5.0% by mass.

The flow improver is used to treat the surface to improve the hydrophobic property and prevent the flowability and electrification property from being deteriorated in a high humidity environment. Examples of the flow improver include silane coupling agents, silylating agents, silane coupling agents having fluorinated alkyl groups, organic titanate coupling agents, aluminum coupling agents, silicone oil, and modified silicone oil.

The cleaning property improver is added to the toner to remove the developer remaining on the photoconductor and primary transfer medium after the transfer. Examples of the cleaning property improver include zinc stearate, calcium stearate, metal salts of aliphatic acids such as stearic acid, and polymer fine particles produced by soap-free emulsion polymerization such as polymethyl methacrylate fine particles and polystyrene fine particles. The polymer fine particles preferably have a relatively narrow particle size distribution and a volume average particle size of 0.01 μm to 1 μm.

The magnetic material is not particularly restricted and can appropriately be selected from known materials according to the purpose. Examples of the magnetic material include iron powder, magnetite, and ferrite. Among them, white ones are preferable in terms of color tone.

An example of the toner producing method will be described hereinafter in which a toner is granulated by producing an adhesive base and obtaining particles from the adhesive base.

The method of producing the adhesive base and granulating the toner includes preparation of an aqueous medium phase, preparation and emulsification/dispersion of a solution or dispersion of toner materials, generation of the adhesive base, removal of the organic solvent, and other operations (such as synthesis of the polymer reactive with the active hydrogen group-containing compound (prepolymer) and synthesis of the active hydrogen group-containing compound).

The aqueous medium phase can be prepared by dispersing the fine resin particles and PAG ester in the aqueous medium. The added amount of the fine resin particles in the aqueous medium is not particularly restricted and can appropriately be set to a desired level according to the purpose. For example, the added amount is preferably 0.5% by mass to 10% by mass.

The solution or dispersion of toner materials can be prepared by dissolving or dispersing in the organic solvent the toner materials such as the active hydrogen group-containing compound, polymer reactive with the active hydrogen group-containing compound, colorant, releasing agent, charge controlling agent, and unmodified polyester resin.

The toner materials except for the polymer reactive with the active hydrogen group-containing compound (prepolymer) can be added to the aqueous medium when the fine resin particles are dispersed in the aqueous medium to prepare the aqueous medium phase or can be added to the aqueous medium phase together with the solution or dispersion when the solution or dispersion is added to the aqueous medium phase.

The emulsification or dispersion can be conducted by emulsifying or dispersing the above prepared solution or dispersion of toner materials in the above prepared aqueous medium phase. During the emulsification or dispersion, the active hydrogen group-containing compound and the polymer reactive with the active hydrogen group-containing compound are subject to extension or crosslinking reaction to produce the adhesive base.

The adhesive base (for example, the urea-modified polyester resin) can be produced for example by (1) emulsifying or dispersing in the aqueous medium phase the solution or dispersion of toner materials including the polymer reactive with the active hydrogen group-containing compound (for example, the isocyanate group-containing polyester prepolymer (A)) together with the active hydrogen group-containing compound (for example, the a mine (B)) to form dispersing elements and allowing them to react for extension or crosslinking in the aqueous medium phase; (2) emulsifying or dispersing the solution or dispersion of toner materials in the aqueous medium where the active hydrogen group-containing compound are previously added to form dispersing elements and allowing them to react for extension or crosslinking in the aqueous medium phase; or (3) adding and mixing the solution or dispersion of toner materials in the aqueous medium, adding the active hydrogen group-containing compound to form dispersing element and allowing them to react for extension or crosslinking from the particle interface in the aqueous medium phase. In the case (3), the modified polyester resin is produced predominantly on the toner surface and the concentration gradient of the toner particles can be obtained.

The reaction conditions for the emulsification or dispersion to produce the adhesive base are not particularly restricted and can appropriately be selected according to the combination of the active hydrogen group-containing compound and the polymer reactive with the active hydrogen group-containing compound. The reaction time is preferably 10 min to 40 hours and more preferably 2 hours to 24 hours. The reaction temperature is preferably 0° C. to 150° C. and more preferably 40° C. to 98° C.

A stable dispersion containing the polymer reactive with the active hydrogen group-containing compound (for example, the isocyanate group-containing polyester prepolymer (A)) in the aqueous medium can be obtained for example by adding to the aqueous medium phase the solution or dispersion prepared by dissolving or dispersing in the organic solvent the toner materials such as the polymer reactive with the active hydrogen group-containing compound (for example, the isocyanate group-containing polyester prepolymer (A)), colorants, releasing agent, charge controlling agent, and unmodified polyester resin and dispersing the mixture under a shearing force.

The dispersion method is not particularly restricted and can appropriately be selected using a known disperser. Examples of the disperser include low speed shear disperser, high speed shear disperser, friction disperser, high pressure jet disperser, and ultrasonic disperser. Among them, the high speed shear disperser is preferable because the particle size of dispersed elements can be controlled to 2 μm to 20 μm.

When the high speed shear disperser is used, conditions such as the rotation speed, dispersion time, and dispersion temperature are not particularly restricted and can appropriately be selected according to the purpose. For example, the rotation speed is preferably 1,000 rpm to 30,000 rpm and more preferably 5,000 rpm to 20,000 rpm. The dispersion time is preferably 0.1 min to 5 min in a batch system. The dispersion temperature is preferably 0° C. to 150° C. and more preferably 40° C. to 98° C. under pressure. The dispersion is usually easily done at higher dispersion temperatures.

The added amount of the aqueous medium for the emulsification or dispersion is preferably 50 parts by mass to 2,000 parts by mass and more preferably 100 parts by mass to 1,000 parts by mass per 100 parts by mass of the toner materials. When lower than 50 parts by mass is used, the toner materials may be subject to poor dispersion and the toner particles may not have a desired particle size. When higher than 2,000 parts by mass is used, the production cost may be increased.

It is preferable to use a dispersant where necessary in the emulsification or dispersion in view of stabilizing dispersed elements (i.e., oil droplets consisting of the solution or dispersion of toner materials) and giving a desired shape and a sharp particle size distribution thereto.

The dispersant is not particularly restricted and can appropriately be selected according to the purpose. Examples of the dispersant include surfactants, water-insoluble inorganic compound dispersants, and polymer protective colloids. They can be used singly or in combination. Among them, surfactants are preferable.

Examples of the surfactants include anionic surfactants, cationic surfactants, noninonic surfactants, and amphoteric surfactants.

Examples of the anionic surfactants include alkyl benzene sulfonate, α-olefin sulfonate and phosphate ester. Those having fluoroalkyl groups are preferable. Examples of anionic surfactants having fluoroalkyl groups include fluoroalkyl carboxylic acid having 2 to 10 carbon atoms or metal salts thereof, disodium perfluorooctanesulfonylglutamate, sodium 3-[omega-fluoroalkyl (having 6 to 11 carbon atoms) oxy]-1-alkyl (having 3 to 4 carbon atoms) sulfonate, sodium 3-[omega-fluoroalkanoyl (having 6 to 8 carbon atoms)-N-ethyl amino]-1-propanesulfonate, fluoroalkyl (having 11 to 20 carbon atoms) carboxylic acid or metal salts thereof, perfluoro alkyl carboxylic acid (having carbon atoms 7 to 13) or metal salts thereof, perfluoroalkyl (having carbon atoms 4 to 12) sulfonate or metal salts thereof, perfluorooctanesulfonate diethanolamide, N-propyl-N-(2-hydroxyethyl)perfluorooctanesulfonamide, perfluoro alkyl (having 6 to 10 carbon atoms) sulfoneamide propyltrimethyl ammonium salts, perfluoroalkyl (having 6 to 10 carbon atoms)-N-ethyl sulfonylglycine salts, and monoperfluoroalkyl (having 6 to 16 carbon atoms) ethylphosphate ester. Examples of the surfactants having fluoroalkyl groups include Surflon S-111, S-112, S-113 (manufactured by Asahi Glass); Frorado FC-93, FC-95, FC-98, FC-129 (manufactured by Sumitomo 3M); Unidyne DS-101, DS-102 (manufactured by Daikin Industry); Megafack F-110, F-120, F-113, F-191, F-812, F-833 (manufactured by Dainippon Ink and Chemicals); Ectop EF-102, 103, 104, 105, 112, 123A, 123B, 306A, 501, 201, 204 (manufactured by Tochem Products); and Futargent F100, F150 manufactured by Neos).

Examples of the cationic surfactants include amine salt surfactants and quaternary ammonium salt cationic surfactants. Examples of the amine salt surfactants include alkyl amine salt, aminoalcohol aliphatic acid derivatives, polyamine aliphatic acid derivatives, and imidazoline. Examples of the quaternary ammonium salt cationic surfactants include alkyl trimethyl ammonium salt, dialkyl dimethyl ammonium salt, alkyl dimethyl benzyl ammonium salt, pyridinium salt, alkylisoquinolium salt, and benzethonium chloride. Among the cationic surfactants, aliphatic-primary, secondary, or tertiary amine acid having fluoroalkyl groups, aliphatic quaternary ammonium salts such as perfluoroalkyl (having 6 to 10 carbon atoms) sulfoneamide propyltrimethyl ammonium salt, benzal conium salt, benzetonium chloride, pyridinium salt, and imidazolium salt are notable. Examples of the commercially available cationic surfactants include Surflon S-121 (manufactured by Asahi Glass); Frorado FC-135 (manufactured by Sumitomo 3M); Unidyne DS-202 (manufactured by Daikin Inductry), Megafack F-150, F-824 (manufactured by Dainippon Ink and Chemicals); Ectop EF-132 (manufactured by Tochem Products); and Futargent F-300 (manufactured by Neos).

Examples of the noninonic surfactants include aliphatic acid amide derivatives and polyalcohol derivatives.

Examples of the amphoteric surfactants include alanine, dodecyldi(aminoethyl)glycine, di(octylaminoethyl)glycine, N-alkyl-N,N-dimethylammoniumbetaine.

Examples of the water-insoluble inorganic compound dispersants include tricalcium phosphate, calcium carbonate, titanium oxide, colloidal silica, and hydroxyapatite.

Examples of the polymer protective colloids include acids, (meth)acrylic monomers containing hydroxyl groups, vinyl alcohol or ethers with vinyl alcohol, esters of compounds containing vinyl alcohol and carboxyl groups, amide compounds or their methylol compounds, chlorides, homopolymers or copolymers containing nitrogen atoms or their heterocyclic rings, polyoxy ethylenes, and celluloses.

Examples of the acids include acrylic acid, methacrylic acid, α-cyanoacrylic acid, α-cyanomethacrylic acid, itaconic acid, crotonic acid, fumaric acid, maleic acid, and maleic anhydride. Examples of the (meth)acrylic monomers containing hydroxyl groups include acrylic acid β-hydroxyethyl, methacrylic acid β-hydroxyethyl, acrylic acid β-hydroxypropyl, methacrylic acid β-hydroxypropyl, acrylic acid γ-hydroxypropyl, methacrylic acid γ-hydroxypropyl, acrylic acid 3-chloro-2-hydroxypropyl, methacrylic acid 3-chloro-2-hydroxypropyl, diethylene glycol monoacrylic acid ester, diethylene glycol monomethacrylic acidester, glycerine monoacrylic acid ester, glycerine monomethacrylic acid ester, N-methylolacrylamide, and N-methylolmethacrylamide. Examples of the vinyl alcohol or vinyl alcohol ethers include vinyl methyl ether, vinyl ethyl ether, and vinyl propyl ether. Examples of the esters of compounds containing vinyl alcohol and carboxyl groups include vinyl acetate, vinyl propionate, and vinyl butyrate. Examples of the amide compounds or their methylol compounds include acrylamide, methacrylamide, diacetone acrylamide acid or their methylol compounds. Examples of the chlorides include acrylic acid chlorides and methacrylic acid chlorides. Examples of the homopolymers or copolymers containing nitrogen atoms or their heterocyclic rings include vinylpyridine, vinylpyrolidone, vinylimidazole, and ethyleneimine. Examples of the polyoxy ethylenes include polyoxy ethylene, polyoxy propylene, polyoxy ethylenealkylamine, polyoxy propylenealkylamine, polyoxy ethylenealkylamide, polyoxy propylenealkylamide, polyoxy ethylenenonylphenyl ether, polyoxy ethylenelaurylphenyl ether, polyoxy ethylenestearyl phenyl ester, and polyoxy ethylenenonyl phenyl ester. Examples of the celluloses include methyl cellulose, hydroxyethyl cellulose, and hydroxypropyl cellulose.

A dispersion stabilizer can be used in the emulsification or dispersion where necessary.

Examples of the dispersion stabilizer include those soluble in acid or base, such as calcium phosphate.

When the dispersion stabilizer is used, calcium phosphate can be removed from fine particles by dissolving the calcium phosphate in an acid such as hydrochloric acid, followed by rinsing with water or decomposition with oxygen.

A catalyst for the extension or crosslinking can be used in the emulsification or dispersion. Examples of the catalyst include dibutyltin laurate and dioctyltin laurate.

The organic solvent is removed from the obtained dispersion (emulsified slurry). The organic solvent can be removed by (1) gradually heating the entire reaction system to allow the organic solvent in the oil droplets to completely evaporate or (2) spraying the emulsified dispersing elements in a dry atmosphere to completely remove the water-insoluble organic solvent in the oil droplets so as to form toner fine particles and simultaneously evaporate the aqueous dispersant.

Toner particles are formed after the organic solvent is removed. The toner particles can be rinsed and dried and then classified as desired. The classification can be done for example by removing fine particles using a cyclone separator, decanter, or centrifugal separation in a liquid. The classification can be done with the powder obtained after dried.

The obtained toner particles can be mixed with the colorant, releasing agent, charge controlling agent, and other particles and further subject to mechanical impact force to prevent the releasing agent and other particles from leaving the toner particle surface.

The mechanical impact force can be applied to the mixture for example by using blades rotating at a high speed or by introducing and accelerating the mixture in a high speed air flow so as to cause the particles to collide against each other or against a proper collision plate. Examples of the apparatus used in the above methods include a modified apparatus of Angmill (ex. Hosokawa Micron), I type Mill (ex. Nippon Neumatic) in which the pulverization air pressure is reduced, Hybridization System (ex. Nara Kikai Seisakujo), Criptron System (ex. Kawasaki Heavy Industry, and automated mortars.

The toner preferably has the following volume average particle size (Dv), volume average particle size (Dv)/number average particle size (Dn), penetration, low-temperature fixing property, offset-free temperature, and glass-transition temperature (Tg).

The toner preferably has a volume average particle size (Dv) of 3 μm to 8 μm and more preferably 4 μm to 6 μm.

When the volume average particle size is smaller than 3 μm, the toner adheres to the carrier surface during a prolonged stirring in the developing unit in the case of two-component developer, which may reduce the electrification ability of the carrier. The filming of toner on the developing roller or the adhesion of toner to the members such as a blade to form a thin layer of toner tends to occur in the case of one-component developer. When the volume average particle size is larger than 8 μm, it is difficult to obtain high resolution and high quality images. The toner particle size largely fluctuates as the toner is taken in/out of the developer.

The toner preferably has a volume average particle size (Dv)-to-number average particle size (Dn) ratio, (Dv/Dn), of 1.00 to 1.25 and more preferably 1.05 to 1.20.

When the ratio (Dv/Dn) is smaller than 1.00, the toner adheres to the carrier surface during a prolonged stirring in the developing unit in the case of two-component developer, which may reduce the electrification ability of the carrier or deteriorate the cleaning property. The filming of toner on the developing roller or the adhesion of toner to the members such as a blade to form a thin layer of toner tends to occur in the case of one-component developer. When the ratio is higher than 1.25, it is difficult to obtain high resolution and high quality images. The toner particle size largely fluctuates as the toner is taken in/out of the developer.

When the ratio (Dv/Dn) of the volume average particle size to the number average particle size is 1.00 to 1.25, excellent storage stability, low-temperature fixing property, and hot offset resistance are obtained and particularly images with excellent glossiness are obtained in a full color copy machine. The toner particle size less fluctuates even after the toner is taken in/out over a prolonged period of time in the case of two-component developer. Excellent stable developing property can be obtained over a prolonged stirring in the developing unit. In the case of one-component developer, the toner particle size less fluctuates and the filming of toner on the developing roller or the adhesion of toner on the members such as a blade to form a thin layer of toner is prevented. Therefore, excellent stable developing property is obtained over prolonged use (stirring) of the developing unit and high quality images can be obtained.

The volume average particle size (Dv) and ratio (Dv/Dn) of the toner can be measured for example by the Coulter Counter. The measurement device for the toner particle size and particle size distribution by the Coulter Counter method can be a Coulter Multisizer III (manufactured by Beckman Coulter).

The penetration is preferably 15 mm or higher and more preferably 20 mm to 30 mm when measured in the penetration test (JIS K2235-1991). When the penetration is lower than 15 mm, the heat-resistance/storage stability may be deteriorated.

The penetration can be measured according to JIS K2235-1991. More specifically, a toner is introduced in a 50 ml glass container and allowed to stand in a constant-temperature bath at 50° C. for 20 hours. The toner is cooled to room temperature and subject to the penetration test. More excellent heat-resistance/storage stability is obtained as penetration becomes higher.

With regard to the low-temperature fixing property, it is preferable that the lowest fixing temperature be lower and the offset-free temperature is higher in view of ensuring both the lower fixing temperature and the offset-free. The temperature range to ensure both the lower fixing temperature and the offset-free is such that the lowest fixing temperature is 140° C. or lower and the offset-free temperature is 200° C. or higher.

The lowest fixing temperature is determined as follows. For example, a transfer paper is placed in an image forming apparatus to make a test copy. The obtained fixed image is rubbed with a pad. The lowest fixing temperature is defined as the temperature at which image density is 70% or higher after rubbing.

The offset-free temperature is determined as follows: For example, an image forming apparatus is adjusted so that a specific amount of a toner to be evaluated is used for developing. The temperature of the fixing member is changed to determine the temperature at which offset does not occur.

The toner preferably has a glass-transition temperature (Tg) of 50° C. to 80° C. and more preferably 50° C. to 65° C. When the glass transition temperature is within these ranges, the toner exhibits excellent heat-resistance/storage stability and low-temperature fixing property. When the glass transition temperature (Tg) is lower than 50° C., the toner may have deteriorated heat-resistance/storage stability. When it is higher than 80° C., the toner may have insufficient low-temperature fixing property.

The glass transition temperature can be measured for example by the TG-DSC system TAS-100 (manufactured by Rigaku Denki) as follows. Approximately 10 mg of toner is introduced in an aluminum sample container. The sample container is placed on a holder unit and mounted in an electric furnace. The sample is heated from room temperature to 150° C. at a temperature increase rate of 10° C./min. The sample is allowed to stand at 150° C. for 10 min. Then, the sample is cooled to room temperature and allowed to stand for 10 min. Subsequently, the sample is heated to 150° C. at a temperature increase rate of 10° C./min in a nitrogen atmosphere and the DSC curve is measured by a differential scanning calorimeter (DSC). The glass-transition temperature (Tg) can be calculated from the obtained DSC curve using the analysis system in the TG-DSC system TAS-100 system based on the contact point of the tangent of the endothermic curve in the vicinity of the glass-transition temperature (Tg) with the baseline.

(Developer)

The developer of the present invention contains at least the toner of the present invention and further contains other appropriately selected component(s) such as a carrier. The developer can be a one-component developer or a two-component developer. When used in high speed printers that support recent increased information processing speeds, the developer is preferably a two-component developer in terms of improved life span.

When a one-component developer is prepared using the toner of the present invention, the toner particle size less fluctuates as the toner is taken in/out and the filming of toner on the developing roller or the adhesion of toner to the members such as a blade to form a thin layer of toner does not occur, whereby excellent stable developing property and images can be obtained over prolonged use (stirring) of the developing unit. When a two-component developer is prepared using the toner of the present invention, the toner particle size less fluctuates as the toner is taken in/out and excellent stable developing property is obtained over prolonged stirring in the developing unit.

-Carrier-

The carrier is not particularly restricted and can appropriately be selected according to the purpose. The carrier preferably has a core material and a resin layer covering the core material.

The core material is not particularly restricted and can appropriately be selected from known materials. For example, manganese-strontium (Mn—Sr)-based materials and manganese-magnesium (Mn—Mg)-based materials of 50 emu/g to 90 emu/g are preferable. Ferromagnetic alloy materials such as iron powder (100 emu/g or higher) and magnetite (75 emu/g to 120 emu/g) are preferable in order to ensure image densities. Feebly-magnetic materials such as copper-zinc (Cu—Zn)-based materials (30 emu/g to 80 emu/g) are preferable because of their milder touch to the photoconductor where the toner stands like spikes. They can be used singly or in combination.

The core material preferably has a volume average particle size of 10 μm to 150 μm and more preferably 40 μm to 100 μm. When the average particle size (volume average particle size ($D_{50}$)) is smaller than 10 μm, there are more fine particles in the carrier particle size distribution. Then, each particle is weakly magnetized and the carrier may be spattered. When the average particle size is larger than 150 μm, the specific surface area is reduced and the toner may be spattered. Particularly, the solid part may not be reproduced well in a full color image with a large solid area.

The material of the resin layer is not particularly restricted and can appropriately be selected from known resins according to the purpose. Examples of the material include amino resins, polyvinyl resins, polystyrene resins, halogenated olefin resins, polyester resins, polycarbonate resins, polyethylene resins, polyvinyl fluoride resins, polyvinylidene fluoride resins, polytrifluoro ethylene resins, polyhexafluoro propylene resins, copolymers of vinylidene fluoride and acryl monomers, copolymers of vinylidene fluoride and vinyl fluoride, fluoro terpolymers of tetrafluoro ethylene, vinylidene fluoride, and non-fluorinated monomers, and silicone resins. They can be used singly or in combination.

Examples of the amino resin include urea-formaldehyde resins, melamine resins, benzoguanamine resins, urea resins, polyamide resins, and epoxy resins. Examples of the polyvinyl resins include acrylic resin, polymethyl methacrylate resin, polyacrylonitrile resin, polyvinyl acetate resin, polyvinyl alcohol resin, and polyvinyl butyral resin. Examples of the polystyrene resins include polystyrene resin and styrene acryl copolymer resin. Examples of the halogenated olefin resin include polyvinyl chloride. Examples of the polyester resins include polyethylene terephthalate resin and polybutylene terephthalate resin.

The resin layer can contain conductive powder where necessary. Examples of the conductive powder include metal powder, carbon black, titanium oxide, tin oxide, and zinc oxide. The conductive powder preferably has an average particle size of 1 μm or smaller. When the average particle size is larger than 1 μm, it may be difficult to control the electric resistance.

The resin layer can be formed for example by dissolving the silicone resin in a solvent to prepare a coating solution, evenly applying the coating solution to the surface of the core material, and drying and baking it. The application may be conducted for example by immersion, spraying, and brushing.

The solvent is not particularly restricted and can appropriately be selected according to the purpose. Examples of the solvent include toluene, xylene, methyl ethyl ketone, methyl isobutyl ketone, cellusolve, and butyl acetate.

The baking is not particularly restricted and can be done by external heating or internal heating. For example, a fixed electric furnace, fluidized electric furnace, rotary electric furnace, or burner furnace, or a microwave can be used.

The content of the resin layer in the carrier is preferably 0.01% by mass to 5.0% by mass. When the content is lower than 0.01% by mass, a uniform resin layer may not be formed on the surface of the core material. When the content is higher than 5.0% by mass, the resin may be excessively thick and causes carrier particles to aggregate, failing to obtain uniformly-sized carrier particles.

When the developer is a two-component developer, the content of the carrier in the two-component developer is not particularly restricted and can appropriately be selected according to the purpose. The content is preferably 90% by mass to 98% by mass and more preferably 93% by mass to 97% by mass.

The developer contains the toner of the present invention and is well charged during the image formation, ensuring stable formation of high-quality images.

The developer can preferably be used in image formation by various known electrophotographic techniques such as magnetic one-component developing, non-magnetic one-component developing, and two-component developing and can particularly preferably be used in the toner container, process cartridge, image forming apparatus, and image forming method of the present invention which will be described hereinafter.

(Toner Container)

The toner container used in the present invention stores therein the toner or developer of the present invention.

The container is not particularly restricted and can appropriately be selected from known containers. For example, the container preferably has a toner container body and a cap.

The toner container body is not particularly restricted in size, shape, structure and material and can appropriately be selected according to the purpose. The container is preferably cylindrical in shape. Those having a spiral ridge on the inner periphery so that the toner therein is shifted to the discharge end as the container rotates and the spiral serves as bellows in part or as a whole are particularly preferable.

The material of the toner container body is not particularly restricted. Materials having dimensional accuracy are preferable, including resins. Preferable examples of the resins include polyester resins, polyethylene resins, polypropylene resins, polystyrene resins, polyvinyl chloride resins, polyacrylic acid, polycarbonate resins, ABS resins, and polyacetal resins.

The toner container is easy to store, transport, and handle and can detachably be attached to the process cartridge or image forming apparatus described later for refilling toner.

(Process Cartridge)

The process cartridge used in the present invention includes at least a latent electrostatic image bearing member that bears thereon a latent electrostatic image and a developing unit configured to develop the latent electrostatic image on the latent electrostatic image bearing member using the developer to form a visible image and, where necessary, further includes other units.

The developing unit includes at least an developer reservoir for reserving the toner of the present invention or the developer and a developer carrier for carrying and transferring the toner or developer reserved in the developer reservoir and may further has a layer thickness control member for controlling the thickness of the toner layer carried.

The process cartridge can be detachably attached to image forming apparatus with various types of electrophotographic systems. It is preferable that the process cartridge be detachably attached to the image forming apparatus to be described later.

The process cartridge includes, for example, a built-in electrostatic latent image bearing member 101, a charging unit 102, a developing unit 104, a transfer unit 108, and a cleaning unit 107 as shown in FIG. 1 and, where necessary, further has other units. In FIG. 1, the number 103 represents light exposure by an exposure unit and the number 105 represents a recording medium.

The image forming process by the process cartridge shown in FIG. 1 is described hereafter. Charged by the charging unit 102 and exposed to light 103 by exposure unit (not shown), the latent electrostatic image bearing member 101 has a latent electrostatic image formed on the surface thereof according to the light exposure image as it rotates in the arrowed direction. The latent electrostatic image is developed by the developing unit 104 and the obtained visible image is transferred to the recording medium 105 by the transfer unit 108 for printout. After the image is transferred, the surface of the latent electrostatic image bearing member is cleaned by the cleaning unit 107 and charge-eliminated by a charge eliminating unit (not shown). Then, the above operation is repeated.

(Image Forming Method and Image Forming Apparatus)

The image forming method used in the present invention includes at least a latent electrostatic image forming step, developing step, transfer step, and fixing step and, where necessary, further includes other appropriately selected steps such as a charge eliminating step, cleaning step, recycling step, and control step.

The image forming apparatus used in the present invention includes at least a latent electrostatic image bearing member, latent electrostatic image forming unit, developing unit, transfer unit, and fixing unit and, where necessary, further has other appropriately selected unit such as a charge eliminating unit, cleaning unit, recycling unit, and control unit.

The latent electrostatic image forming step is a step of forming a latent electrostatic image on the latent electrostatic image bearing member.

The latent electrostatic image bearing member (occasionally referred to as "electrophotographic photoconductor," "photoconductor," or "image bearing member" hereinafter) is not particularly restricted in material, shape, structure, and size and can appropriately be selected from those known in the art. The image bearing member is preferably in the form of a drum. Examples of the material include inorganic photosensitive materials such as amorphous silicon and selenium and organic photosensitive materials such as polysilane and phthalopolymethine. Among them, amorphous silicon is preferable in terms of long life span.

The latent electrostatic image can be formed for example by uniformly charging the surface of the latent electrostatic image bearing member followed by imagewise-exposure. This can be realized by the latent electrostatic image forming unit. For example, the latent electrostatic image forming unit includes at least a charger for uniformly charging the surface of the latent electrostatic image bearing member and an exposure unit for exposing the surface of the latent electrostatic image bearing member according to an image.

The charging is conducted using the charger for example by is applying a voltage to the surface of the latent electrostatic image bearing member.

The charger is not particularly restricted and can appropriately be selected according to the purpose. Examples of the charger include per se known contact chargers provided with a conductive or semiconductive roll, brush, film, or rubber blade and non-contact chargers using corona discharge such as corotron and scorotron.

The exposure can be conducted using the exposure unit for example by exposing the surface of the latent electrostatic image bearing member according to an image.

The exposure unit is not particularly restricted and can appropriately be selected according to the purpose as long as it can exposure the charged surface of the latent electrostatic image bearing member according to an image. Examples of the exposure unit include various exposure units such as copy optical systems, rod lens array systems, laser optical systems, and liquid crystal shutter optical systems.

The back-lighting system in which the latent electrostatic image bearing member is exposed on the back according to an image can be used in the present invention.

-Developing Step and Developing Unit-

The developing step is a step of developing the latent electrostatic image using the toner or developer of the present invention to form a visible image.

The visible image can be formed for example by developing the latent electrostatic image using the toner or developer of the present invention, which can be realized by the developing unit.

The developing unit is not particularly restricted and can appropriately be selected from known units as long as it is capable image development using the toner or developer of the present invention. Preferably, the developing unit includes at least a developing element that contains therein the toner or developer of the present invention and can supply the toner or developer to the latent electrostatic image in a contact or non-contact manner. More preferably, the developing element is provided with the toner container.

The developing element can be of a dry or wet developing system. Furthermore, it can be a monochromic or multicolor developing unit. Preferably, the developing unit has a stirrer for stirring the toner or developer with friction for charging and a rotatable magnet roller.

In the developing element, for example, the toner and carrier are mixed and stirred with friction, which causes the toner to be charged. Then, the toner stands on the surface of the rotating magnet roller like spikes and forms a magnetic brush. The magnet roller is placed near the latent electrostatic image bearing member (photoconductor). Some toner particles constituting the magnetic brush on the surface of the magnetic roller are shifted to the surface of the latent electrostatic image bearing member (photoconductor) by means of electric attraction. Consequently, the latent electrostatic image is developed on the surface of the latent electrostatic image bearing member (photoconductor) by the toner, forming a visible image.

The developer contained in the developing element is a developer containing the toner of the present invention. The developer can be a one-component developer or a two-component developer. The toner contained in the developer is the toner of the present invention.

-Transfer Step and Transfer Unit-

The transfer step is a step of transferring the visible image to a recording medium. Preferably, the visible image is transferred to an intermediate transfer body in the first transfer and the visible image is transferred to the recording medium in the second transfer. More preferably, the toner is of two or more colors, preferably a full color toner, and the visible image is transferred to the intermediate transfer body to form a complex transferred image in the first transfer step and the complex transferred image is transferred to the recoding medium in the second transfer step.

The transfer can be conducted for example by charging the latent electrostatic image bearing member (photoconductor) in the form of the visible image using the transfer charger, which can be realized by the transfer unit. The transfer unit preferably has a first transfer unit configured to transfer a visible image to the intermediate transfer body to form a complex transferred image and a second transfer unit configured to transfer the complex transferred image to a recording medium.

The intermediate transfer body is not particularly restricted and can appropriately be selected from known transfer bodies according to the purpose. For example, a transfer belt is preferable.

It is preferable that the transfer unit (the first and second transfer units) include at least a transfer element for separating and charging the visible image formed on the latent electrostatic image bearing member (photoconductor) for transfer onto the recording medium. One or more of the transfer units can be provided.

The transfer element can be a corona transfer element using corona discharge, transfer belt, transfer roller, pressure transfer roller, or adhesion transfer element.

The recording medium is not particularly restricted and can appropriately be selected from known recording media (recording paper).

The fixing step is a step of fixing the visible image transferred to the recording medium using a fixing unit. The fixing step can be conducted for each color transferred to the recording medium or for the colors layered at one time.

The fixing unit is not particularly restricted and can appropriately be selected according to the purpose. Known heating/pressurizing units are preferable. Examples of the heating/pressurizing unit include a combination of heating and pressurizing rollers and a combination of heating and pressurizing rollers and an endless belt.

Heating by the heating/pressurizing unit is preferably conducted at a temperature from 80° C. to 200° C.

In the present invention, for example, a known optical fixing unit can be used together with or in place of the fixing step and fixing unit according to the purpose.

The charge eliminating step is a step of applying a charge eliminating bias to the latent electrostatic image bearing member for removal of charge, which step is preferably conducted by the charge eliminating unit.

The charge eliminating unit is not particularly restricted and can appropriately be selected from known charge eliminators as long as they can apply charge eliminating bias to the latent electrostatic image bearing member. For example, charge eliminating lamps are preferable.

The cleaning step is a step of removing residual toner on the latent electrostatic image bearing member, which is preferably conducted by the cleaning unit.

The cleaning unit is not particularly restricted and can appropriately be selected from known cleaners as long as they can remove electrophotographic toner remaining on the latent electrostatic image bearing member. For example, a magnetic brush, electrostatic brush, magnetic roller cleaner, blade cleaner, brush cleaner, and web cleaner are preferable.

The recycling step is a step of recycling the toner removed in the cleaning step to the developing unit, which is preferably conducted by the recycling unit.

The recycling unit is not particularly restricted. Known transport units can be used.

The control step is a step of controlling the above steps, which is preferably conducted by the control unit.

The control unit is not particularly restricted and can appropriately be selected according to the purpose as long as it can control the operation of each unit. For example, devices such as sequencers and computers can be used.

Figure 2:
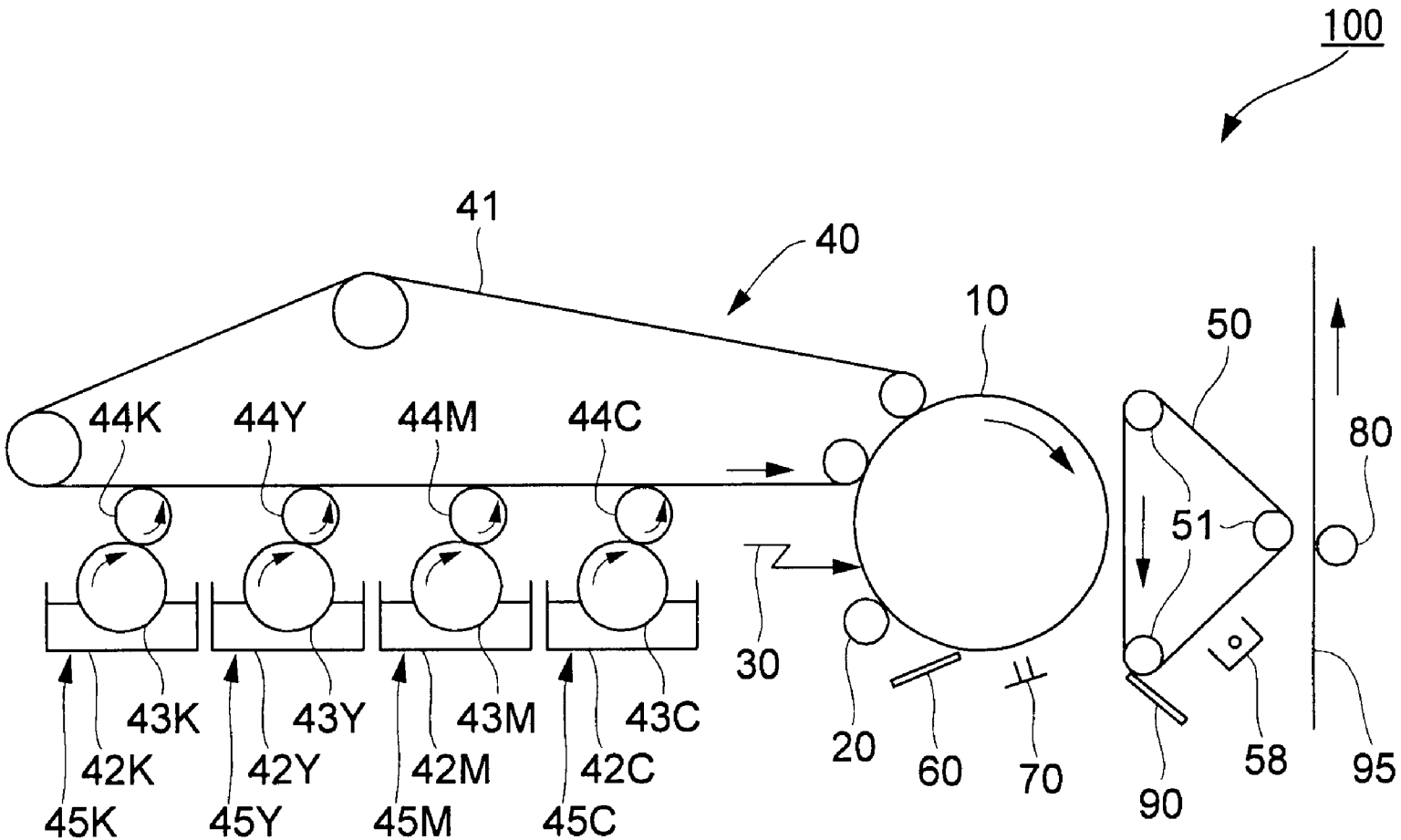
FIG. 2 is a schematic illustration for explaining an example of an image forming method realized by an image forming apparatus used in the present invention.

An embodiment of the image forming method of the present invention realized in the above described image forming apparatus is described hereafter with reference to FIG. 2. An image forming apparatus 100 shown in FIG. 2 has a photoconductor drum 10 as the latent electrostatic image bearing member, a charging roller 20 as the charging unit, an exposure unit 30 as the exposure unit, a developing device 40 as the developing unit, an intermediate transfer body 50, a cleaning unit 60 having a cleaning blade as the cleaning unit, and a charge eliminating lamp 70 as the charge eliminating unit.

The intermediate transfer body 50 is an endless belt running around three rollers 51 provided inside thereof and movable in the arrowed direction in the figure. The three rollers 51 partly serve as a transfer bias roller that applies a specific transfer bias (the first transfer bias) to the intermediate transfer body 50. An intermediate transfer body cleaning blade 90 is provided near the intermediate transfer body 50. Facing the intermediate transfer body 50, a transfer roller 80 is provided as the transfer unit that applies a transfer bias for transferring the visible image (toner image) to a recording medium 95 (the second transfer). A corona charger 58 for charging the visible image on the intermediate transfer body 50 is provided near the intermediate transfer body 50 at a position between the contact point of the latent electrostatic image bearing member 10 with the intermediate transfer body 50 and the contact point of the intermediate transfer body 50 with the recording medium 95 in the rotation direction of the intermediate transfer body 50.

The developing unit 40 is constituted by a developing belt 41 as the developer carrier and a black developing unit 45K, a yellow developing unit 45Y, a magenta developing unit 45M, and a cyan developing unit 45C provided around the developing belt 41. The black developing unit 45K has a developer reservoir 42K, a developer supply roller 43K, and a developing roller 44K. The yellow developing unit 45Y has a developer reservoir 42Y, a developer supply roller 43Y, and a developing roller 44Y. The magenta developing unit 45M has a developer reservoir 42M, a developer supply roller 43M, and a developing roller 44M. The cyan developing unit 45C has a developer reservoir 42C, a developer supply roller 43C, and a developing roller 44C. The developing belt 41 is an endless belt, runs around multiple belt rollers, and is partially in contact with the latent electrostatic image bearing member 10.

In the image forming apparatus 100 shown in FIG. 2, for example, the photoconductor drum 10 is uniformly charged by the charging roller 20. The exposure unit 30 exposes the photoconductor drum 10 according to an image to form a latent electrostatic image. The latent electrostatic image formed on the photoconductor drum 10 is developed using the toner supplied from the developing unit 40 to form a visible image (toner image). The visible image (toner image) is transferred to the intermediate transfer body 50 by a voltage applied from the rollers 51 (the first transfer) and further transferred to the transfer paper 95 (the second transfer). Consequently, a transferred image is formed on the transfer paper 95. Residual toner on the photoconductor 10 is removed by the cleaning unit 60 and the photoconductor 10 is once charge-eliminated by the charge eliminating lamp 70.

Figure 3:
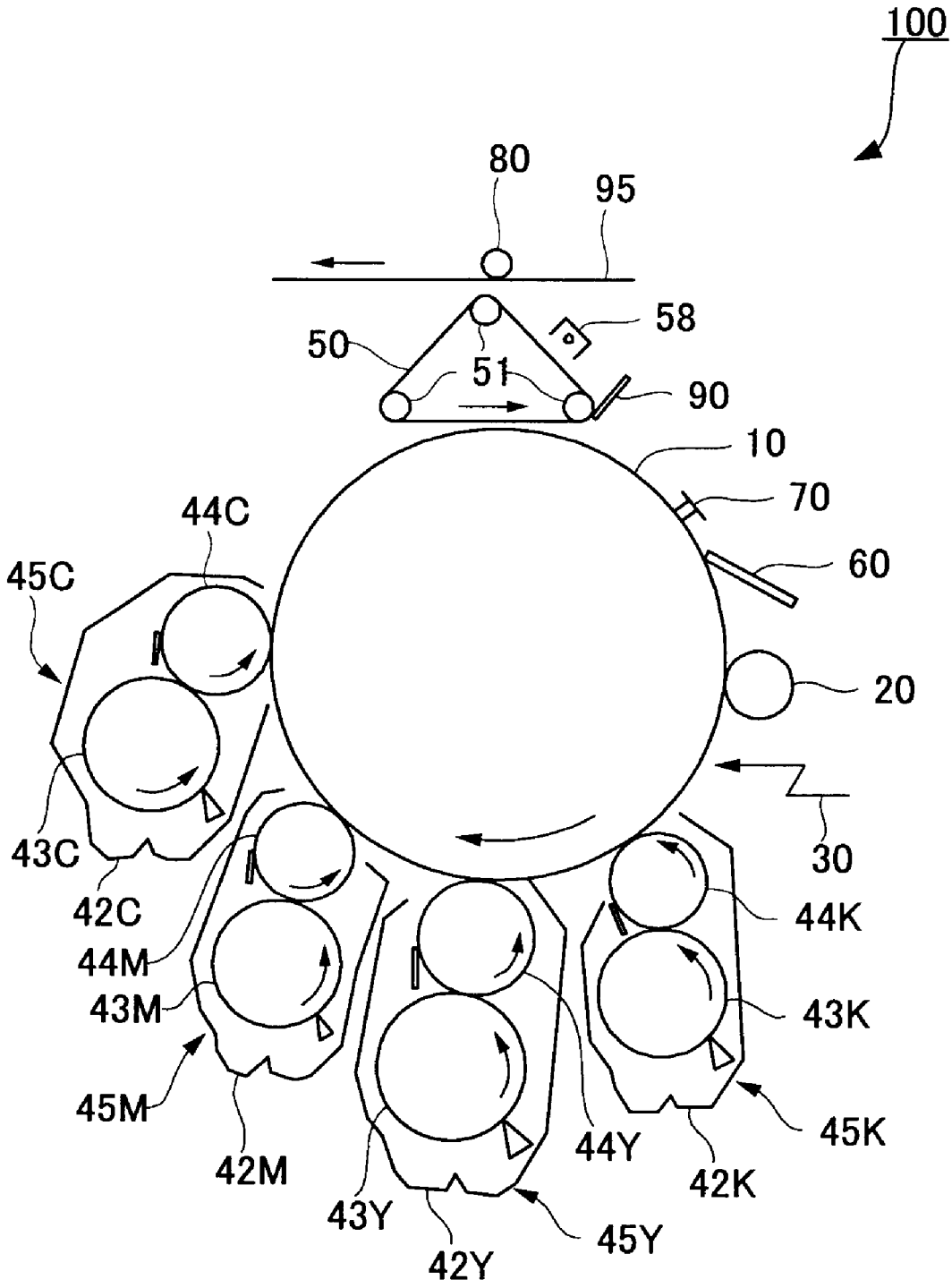
FIG. 3 is a schematic illustration for explaining another example of the image forming method realized by the image forming apparatus used in the present invention.

Another embodiment of the image forming method in the present invention realized in the above described the image forming apparatus will described hereinafter with reference to FIG. 3. An image forming apparatus 100 shown in FIG. 3 has the same structure and effects as the image forming apparatus 100 shown in FIG. 2 except that the developing belt 41 is not provided and the black developing unit 45K, yellow developing unit 45Y, magenta developing unit 45M, and cyan developing unit 45C directly face the photoconductor 10. In FIG. 3, the same components as in FIG. 2 are given the same reference numbers.

Figure 4:
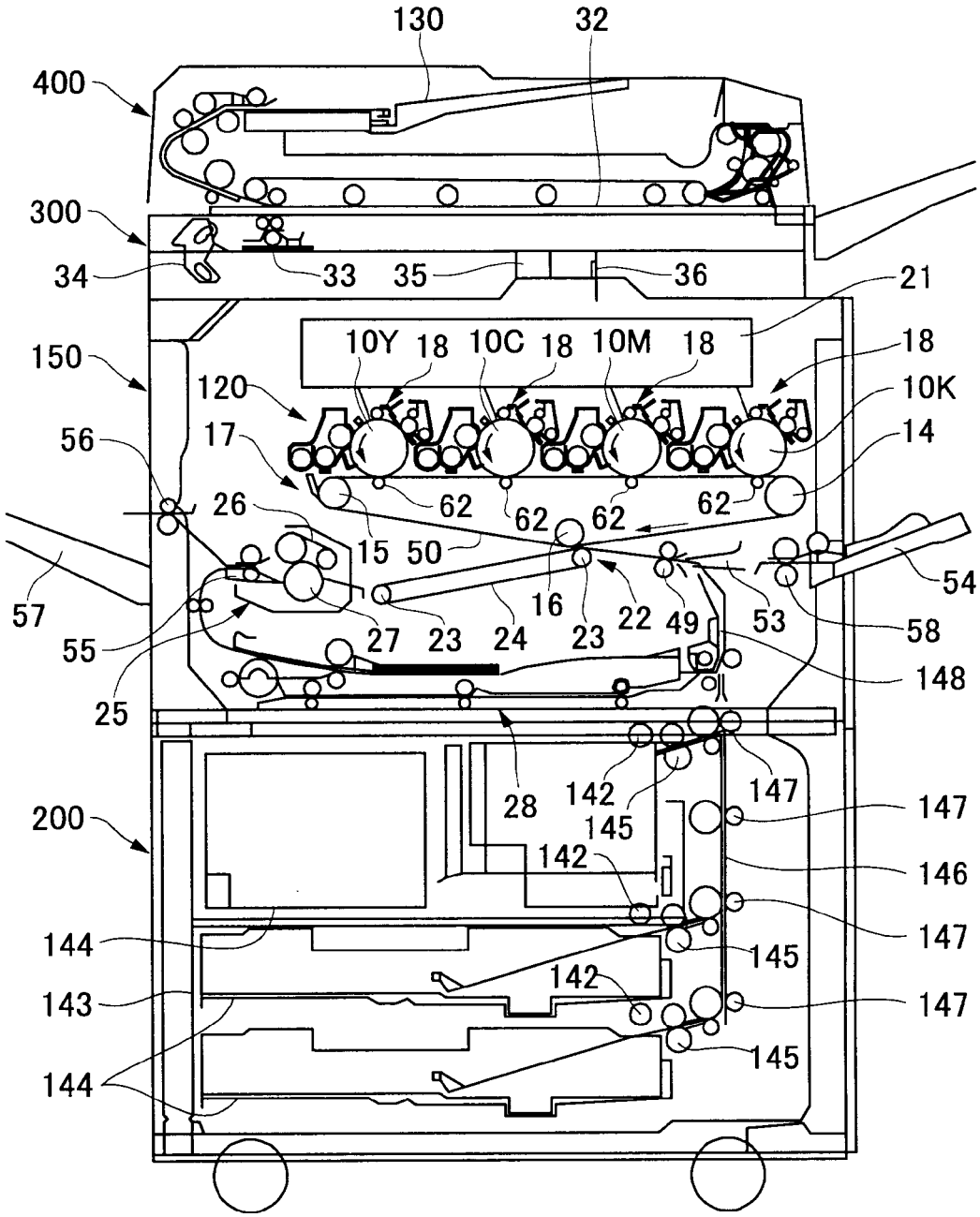
FIG. 4 is a schematic illustration for explaining an example of the image forming method realized by the image forming apparatus (a tandem-type color image forming apparatus) used in the present invention.

Another embodiment of the image forming method in the present invention realized in the above described image forming apparatus will be described hereinafter with reference to FIG. 4. A tandem image forming apparatus shown in FIG. 4 is a tandem-type color image forming apparatus. The tandem image forming apparatus has a copy unit body 150, a paper feed table 200, a scanner 300, and an automated document feeder (ADF) 400.

The copy unit body 150 has an endless belt intermediate transfer body 50 in the center. The intermediate transfer body 50 runs around support rollers 14, 15, and 16 and rotates clockwise in FIG. 4. An intermediate transfer body cleaning unit 17 for removing residual toner on the intermediate transfer body 50 is provided near the support roller 15. A tandem developing unit 120 has four, yellow, cyan, magenta, and black, image forming unit 18 facing the intermediate transfer body 50 running around the support rollers 14 and 15 and arranged in the transfer rotation direction thereof. An exposure unit 21 is provided near the tandem developing unit 120. A second transfer unit 22 is provided across the intermediate transfer body 50 from the tandem developing unit 120. The second transfer unit 22 has an endless second transfer belt 24 running around a pair of rollers 23. A transfer paper transferred on the second transfer belt 24 and the intermediate transfer body 50 can make contact with each other. A fixing unit 25 is provided near the second transfer unit 22. The fixing unit 25 has an endless fixing belt 26 and a pressure roller 27 pressed against the fixing belt 26.

In the tandem image forming apparatus, a sheet inversion unit 28 for forming images on both sides of a transfer sheet is provided near the second transfer unit 22 and fixing unit 25.

Formation of color images (color copies) with the tandem developing unit 120 will be described hereinafter. First, a document is placed on a document table 130 of the automated document feeder (ADF) 400. Alternatively, the automated document feeder 400 is opened, a document is placed on a contact glass 32 of the scanner 300, and the automated document feeder 400 is closed.

When the start switch (not shown) is pushed, the scanner is activated after the document on the automated document feeder 400 is shifted onto the contact glass 32 in the case that the document is placed on the automated document feeder 400 or the scanner is activated immediately in the case that the document is placed on the contact glass 32, whereby a first scanning element 33 and a second scanning element 34 scan. The first scanning element 33 serves to illuminate the document with light from a light source. The light reflected by the document is reflected by a mirror of the second scanning element 34 and received by a reading sensor 36 via an imaging lens 35 so that the color document (color image) is read and black, yellow, magenta, and cyan image information is created.

Figure 5:
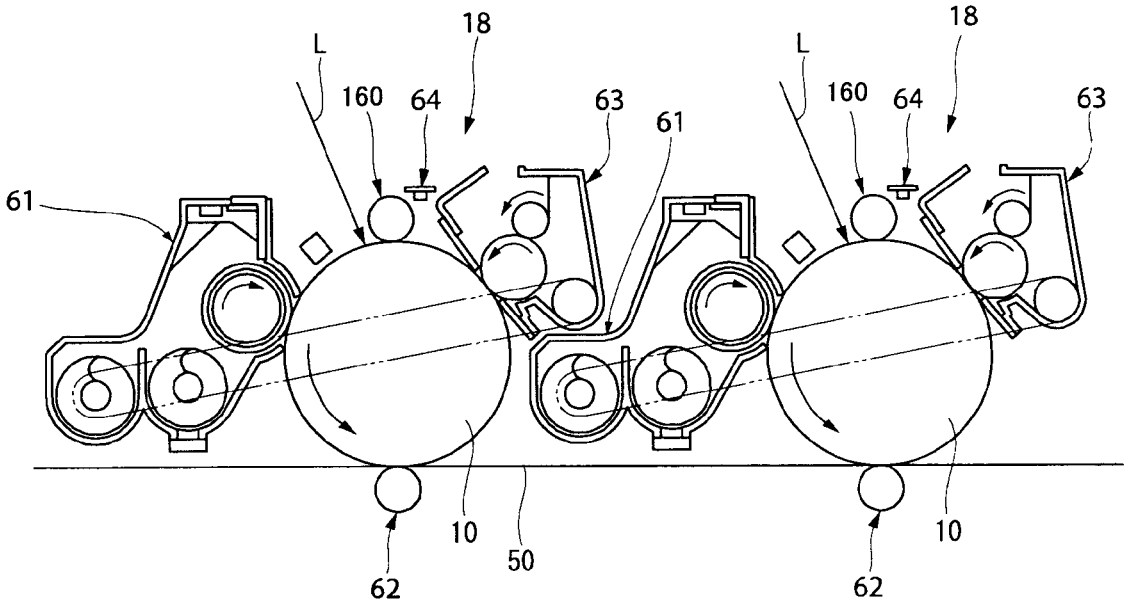
FIG. 5 is a partial enlarged schematic illustration of the image forming apparatus shown in FIG. 4.

The black, yellow, magenta, and cyan image information is supplied to respective image forming unit 18 (black image forming unit, yellow image forming unit, magenta image forming unit, and cyan image forming unit) in the tandem developing unit 120, where black, yellow, magenta, and cyan toner images are formed. Each image forming unit 18 in the tandem developing unit 120 (black image forming unit, yellow image forming unit, magenta image forming unit, and cyan image forming unit) has, as shown in FIG. 5, a latent electrostatic image bearing member 10 (black latent electrostatic latent image bearing member 10K, yellow latent electrostatic latent image bearing member 10Y, magenta latent electrostatic latent image bearing member 10M, and cyan latent electrostatic image bearing member 10C), a charging unit 160 for uniformly charging the latent electrostatic image bearing member 10, an exposure unit for exposing the latent electrostatic image bearing member according to a corresponding color image based on each color image information (L in FIG. 5) to form a latent electrostatic image corresponding to each color image on the latent electrostatic image bearing member, a developing unit 61 for developing the latent electrostatic image using each color toner (black toner, yellow toner, magenta toner, and cyan toner) to form a toner image in each color toner, a transfer charger 62 for transferring the toner image onto the intermediate transfer body 50, a cleaning unit 63, and a charge eliminating unit 64, whereby each single color image (black, yellow, magenta, and cyan images) can be formed based on the respective color image information. Then, the formed black, yellow, magenta, and cyan images are sequentially transferred to the intermediate transfer body 50 rotated and shifted by the support rollers 14, 15, and 16 to form a black image on the black latent electrostatic image bearing member 10K, an yellow image on the yellow latent electrostatic image bearing member 10Y, a magenta image on the magenta latent electrostatic image bearing member 10M, and a cyan image on the cyan latent electrostatic image bearing member 10C (the first transfer). Subsequently, the black, yellow, magenta, and cyan images are superimposed on the intermediate transfer body 50 to form a merged color image (transferred color image).

On the other hand, in the paper feed table 200, one of the paper feed rollers 142 is selectively rotated and a sheet (recording paper) is taken from one of multiple paper feed cassettes 144 in the paper bank 143 and supplied to a paper passage 146 one by one through separation by a separation roller 145. Then, the sheet is further advanced to a paper passage 148 in the copy machine body 150 by an advancing roller 147. The paper stops when it reaches a resistance roller 49. Alternatively, the paper feed roller 142 is rotated to advance a sheet (recording paper) on the manual paper feed tray 54. The sheet is inserted in a manual paper passage 53 one by one through separation by a separation roller 145. The paper stops when it reaches the resistance roller 49. The resistance roller 49 is generally connected to ground. It can be biased to remove sheet powder. The resistance roller 49 is rotated in sync with the merged color image (transferred color image) on the intermediate transfer body 50. The sheet (recording paper) is supplied between the intermediate transfer body 50 and the second transfer unit 22 to transfer the merged color image (transferred color image) to the sheet (recording sheet) by the second transfer unit 22 (the second transfer), whereby a color image is transferred and formed on the sheet (recording paper). Residual toner on the intermediate transfer body 50 is cleaned by the intermediate transfer body cleaning unit 17 after the image is transferred.

The sheet (recording paper) on which the color image is transferred is supplied to the fixing unit 25 by the second transfer unit 22. In the fixing unit 25, the merged color image (transferred color image) is fixed on the sheet (recording paper) by heat and pressure. Then, the sheet (recording paper) is turned by a turning claw 55, discharged by a discharging roller 56, and stacked on a feed tray 57. Alternatively, the sheet is turned by the turning claw 55, reversed by the sheet reverse unit 28, and again guided to the transfer position. Then, an image is recorded on the back, and the sheet is then discharged by the discharge roller 56 and stacked on the feed tray 57.

The image forming apparatus and image forming method used in the present invention uses the toner of the present invention having excellent properties such as flowability and fixing property and ensuring both the low-temperature fixing property and the heat-resistance/storage stability, whereby high quality images can efficiently be obtained.

Hereinafter Examples of the present invention will be described; however, the present invention is not limited in scope to these Examples. Note that "part(s)" means "part(s) by mass" unless otherwise indicated.

EXAMPLE 1

<Adhesive Base Formation Process>

Toner was produced in the manner described below.

-Preparation of Solution/Dispersion of Toner Materials-

-Synthesis of Unmodified Polyester (Low Molecule Polyester)-

To a reactor equipped with a cooling pipe, an agitator and a nitrogen feed tube was added 67 parts of an ethylene oxide bisphenol A 2 mol adduct, 84 parts of bisphenol A propion oxide 3 mol adduct, 274 parts of terephthalic acid, and 2 parts of dibutyltin oxide. These ingredients were reacted for 8 hours at normal pressure at 230° C. Next, the resultant reaction solution was reacted for 5 hours under the reduced pressure of 10 mmHg to 15 mmHg, preparing a unmodified polyester.

The obtained unmodified polyester had a number average molecular weight (Mn) of 2,100, a weight average molecular weight of 5,600, and a glass transition temperature (Tg) of 55° C.

-Preparation of Master Batch (Mb)-

Using Henschel mixer (manufactured by Mitsuikozan Co., Ltd.) 1,000 parts of water, 540 parts of carbon black ("Printex 35," manufactured by Degussa, DBP oil absorption=42 ml/100 g, pH=9.5), and 1,200 parts of the unmodified polyester were mixed. The mixture was kneaded with a twin roll at 50° C. for 30 minutes, rolled, cooled, and pulvreized in a pulverizer (manufactured by Hosokawa Micron Co., Ltd) to prepare the master batch.

-Synthesis of Urea-modified Polyester-

To a reaction vessel equipped with a cooling pipe, an agitator, and a nitrogen feed tube was added 682 parts of ethylene oxide bisphenol A 2 mol adduct, 81 parts of bisphenol A propylene oxide 2 mol adduct, 283 parts of terephthalic acid, 22 parts of anhydrous mellitic acid, and 2 parts of dibutyltin oxide, and these ingredients were reacted at 230° C. for 8 hours at normal pressure. Next, the resultant mixture was reacted for 5 hours under reduced pressure of 10 mHg to 15 mHg, preparing an intermediate polyester.

The obtained intermediate polyester had a number average molecular weight (Mn) of 2,100, weight average molecular weight of 9,600, glass transition temperature (Tg) of 55° C., acid number of 0.5 mg KOH/g, and hydroxyl value of 49 mg KOH/g.

Next, to a reaction vessel equipped with a cooling pipe, an agitator, and a nitrogen feed tube was added 411 parts of the foregoing intermediate polyester, 89 parts of isophoronediisocyanate, and 500 parts of ethyl acetate. These ingredients were reacted for 5 hours at 100° C., preparing a urea-modified polyester, a polymer reactive with the active hydrogen group-containing compound.

The content of free isocyanate in the obtained urea-modified polyester was 1.60% by mass and the solid content of the urea-modified polyester (after being left for 45 minutes at 150° C.) was 50% by mass.

-Synthesis of Ketimine (the Active Hydrogen Group-containing Compound)-

In a reaction vessel quipped with a stirring rod and a thermometer was added 30 parts of isophoronethiamine and 70 parts of methyl ethyl ketone, and these ingredients were reacted at 50° C. for 5 minutes, thereby preparing a ketimine compound (the active hydrogen group-containing compound).

The amine value of the obtained ketimine compound (active hydrogen group containing compound) was 423.

-Preparation of Solution/Dispersion of Toner Materials-

In a beaker was added 15 parts of the urea-modified polyester, 60 parts of the unmodified polyester and 100 parts of ethyl acetate, and the mixture was agitated to dissolve the ingredients. Next, 10 parts of carnauba wax (molecular weight=1,800, acid number=2.5 mg KOH/g, penetration=1.5 mm (40° C.), melting point=86° C.) and 10 parts of the foregoing master batch were placed in the beaker. Using a bead mill ("Ultravisco Mill," manufacture by the IMEX Co., Ltd.) loaded with 0.5 mm diameter zirconia beads in a proportion of 80 vol %, a raw material solution was prepared under conditions of a liquid feed speed of 1 kg/hr and a disk circumferential speed of 6 m/s in 3-pass operation, followed by addition of 2.7 parts of ketimine to the raw material solution to prepare a solution/dispersion of toner materials.

-Preparation of Fine Resin Particle Emulsion-

In a reaction vessel equipped with a stirring rod and a thermometer was added 683 parts of water, 11 parts of mass-methacrylic acid ethyleneoxide adduct sulfate ester sodium salt (Eleminol RS-30, Sanyo Kasei Co., Ltd.), 79 parts of styrene, 79 parts of methacrylic acid, 105 parts of butyl acrylate, 13 parts of divinyl benzene and 1 part of butyl acrylate, and these ingredients were stirred at 400 rpm for 15 minutes to obtain a white suspension. The reaction vessel was heated to 75° C. to proceed reaction for 5 hours. Furthermore, by adding 30 parts of a 1% by mass aqueous solution of ammonium persulfate, and the mixture was held at 75° C. for 5 hours to obtain an aqueous dispersion (fine particle dispersion) of a vinyl resin (copolymer of styrene-methacrylic acid-butyl acrylate-methacrylic acid ethylene oxide adduct sulfate ester sodium salt).

The volume average particle size of the obtained fine particle dispersion, as measured with a laser diffraction particle size analyzer (LA-920, manufactured by Horiba Seisakujo), was 105 nm. A portion of the fine particle dispersion was dried to isolate a resin content. The resin content had a glass transition temperature (Tg) of 95° C., number average molecular weight of 140,000, and weight average molecular weight of 980,000.

-Aqueous Medium Phase Preparation-

An aqueous medium phase was prepared by mixing together 306 parts of ion-exchanged water, 30 parts of polyethyleneglycol dibehenate No. 1 (weight average molecular weight=20,000, melting point=66° C., the number of carbon atoms in the aliphatic acid (R)=22), 60 parts of fine resin particles dispersion, and 4 parts of sodium dodecylbenzene sulphonate, and by homogenenously dissolving them. At this time, the content of polyethyleneglycol dibehenate No. 1 was 10.0% by mass relative to the entire toner composition. In addition, the content of the fine resin particles in toner was 2.0% by mass. The content of the fine resin particles was determined by pyrolysis gas chromatography/mass spectroscopy of a substance that is derived from fine resin particles rather than toner particles (the substance corresponds to a monomer that constitutes the fine resin particle but is not contained in other toner ingredients, e.g., any of styrene, methacrylic acid, butyl acrylate and ethylene oxide in the case where the fine resin particle is composed of a co-polymer of styrene, methacrylic acid, butyl acrylate, methacrylic acid, and hyleneoxide adduct sulfate ester sodium salt) to measure the peak area of the substance. As a detector, a mass spectrometer was used (the same measurement was made in the following Examples and Comparative Examples).

-Emulsification/Dispersion Preparation-

In a vessel was placed 150 parts of the foregoing aqueous medium phase, and using a TK Homomixer (manufactured by Tokushu Kika Chemical Co., Ltd), the aqueous medium phase was agitated at 12,000 rpm, and by adding 100 parts of the dispersion of toner materials followed by 10 min-mixing an emulsification/dispersion (emulsification slurry) was prepared.

-Removal of Organic Solvent-

A flask equipped with an agitator and a thermometer, preparation was charged with 100 parts of the emulsification slurry. While agitating at a rate of 20 m/minutes the solvent was removed over a period of 12 hours at 30° C.

-Washing and Drying-

After filtering 100 parts of the dispersion slurry under reduced pressure, 100 parts of ion-exchanged water was added to a filtration cake, and was filtered after mixing with a TK Homomixer (manufactured by Tokushukika Co., Ltd) (for 10 minutes at 12,000 rpm). Subsequently, 300 parts of ion-exchanged water was added to the filtration cake, and mixing was performed with a TK Homomixer (for 10 minutes at 12,000 rpm). Filtration was performed twice. After adding 20 parts of a 10% by mass aqueous solution of sodium hydroxide to the obtained filtration cake and mixed with a TK Homomixer (for 30 minutes at 12,000 rpm), filtration was performed under reduced pressure. Filtration was performed after adding 300 parts of ion-exchanged water to the obtained filtration cake, and mixed with a TK Homomixer (for 10 minutes at 12,000 rpm). After adding 300 parts of ion-exchanged water to the obtained filtration cake and mixed with a TK Homomixer (for 10 minutes at 12,000 rpm), filtration was performed twice. Furthermore, filtration was performed after adding 20 parts of 10% by mass hydrochloric acid to the obtained filtration cake, and mixed with a TK Homomixer (for 10 minutes at 12,000 rpm). After adding 300 parts of ion-exchanged water to the obtained filtration cake, and mixing it with a TK Homomixer (for 10 minutes at 12,000 rpm), filtration was performed twice to obtain a final filtration cake. The obtained final filtration cake was dried for 48 hours at 45° C. with a circulation air drier, and toner particles of Example 1 were obtained by passing it through a 75 μm mesh sieve.

EXAMPLE 2

Toner base particles of Example 2 were produced in the same manner as in Example 1 except that in the preparation of an aqueous medium phase, polyethyleneglycol dibehenate No. 1 was changed to polyethyleneglycol dibehenate No. 2 (weight average molecular weight=2,500, melting point=52° C.).

EXAMPLE 3

Toner base particles of Example 3 were produced in the same manner as in Example 1 except that in the preparation of an aqueous medium phase, polyethyleneglycol dibehenate No. 1 was changed to polyethyleneglycol dibehenate No. 3 (weight average molecular weight=8,000, melting point=60° C.), and that the added amount of the fine resin particle dispersion was doubled (120 parts).

EXAMPLE 4

Toner base particles of Example 4 were produced in the same manner as in Example 1 except that in the preparation of an aqueous medium phase, the added amount of the fine resin particle dispersion was doubled (120 parts).

EXAMPLE 5

Toner base particles of Example 5 were produced in the same manner as in Example 1 except that in the preparation of an aqueous medium phase, polyethyleneglycol dibehenate No. 1 was changed to polyethyleneglycol dilaurate (weight average molecular weight=20,000, melting point=64° C., and the number of carbon chains in the aliphatic acid (R)=12).

EXAMPLE 6

Toner base particles of Example 6 were produced in the same manner as in Example 1 except that in the preparation of an aqueous medium phase, polyethyleneglycol dibehenate No. 1 was changed to a polyethyleneglycol dicaprylate acid ester (weight average molecular weight=20,000, melting point=62° C., and the number of carbon chains in the aliphatic acid (R)=8).

EXAMPLE 7

Toner base particles of Example 7 were produced in the same manner as in Example 1 except that in the preparation of an aqueous medium phase, the added amount of polyethyleneglycol dibehenate No. 1 was changed to 9 parts.

EXAMPLE 8

Toner base particles of Example 8 were produced in the same manner as in Example 1 except that in the preparation of an aqueous medium phase, the added amount of the fine resin particle dispersion was changed to 1.8 parts, and that the added amount of polyethyleneglycol dibehenate No. 1 was changed to 15 parts.

EXAMPLE 9

Toner base particles of Example 9 were produced in the same manner as in Example 1 except that in the preparation of solution/ dispersion of toner materials, paraffin wax (melting point=77° C., acid number=0 mg KOH/g) was used in place of carnauba wax.

EXAMPLE 10

As will be described below, toner was produced by the suspension polymerization method.

-Preparation of Toner Material Solution/Dispersion (Monomer Composition)-

A monomer composition was prepared in the following manner: 100 parts of polymerizable monomers consisting of 80.5 parts of styrene and 19.5 parts of n-butyl acrylate, 6 parts of carbon black ("Printex 35", manufactured by Degussa, DBP oil absorption=42 ml/100 g, pH=9.5), 1 part of charge control agent ("spiron black TRH," manufactured by Hodogaya Chemical Co., Ltd), 0.4 parts of divinylbenzene, 1.0 part of t-dodecylmercaptan, 10 parts of carnauba wax, and 0.5 parts of polymethacrylic acid ester macromonomer were mixed using an agitation device at room temperature, and, a media type disperser was used to produce a homogeneous dispersion.

-Aqueous Medium Phase Preparation-

An aqueous medium phase was prepared by mixing together 10 parts of the fine particle dispersion prepared in Example 1, 10 parts of polyethyleneglycol dibehenate No. 1 (weight average molecular weight=20,000, melting point=66° C., the number of carbon atoms in the aliphatic acid (R)=22), and 80 parts of a 2% by mass aqueous solution of sodium dodecylbenzene sulphonate.

-Toner Granulation-

The monomer composition was added into the obtained magnesium hydrate colloid dispersion at room temperature, and droplets were dispersed until by agitation until they were stabilized. Thereafter, and as an oil-soluble polymerization initiator, t-butylperoxyl-2-ethylhexanoate was added in an amount of 5 parts. Next, agitation was performed at a high shear speed with a TK Homomixer (manufactured by the Tokushu Kika Co., Ltd) for 10 minutes at 15000 rpm, forming fine droplets of monomer components.

-Polymerization-

The aqueous dispersion medium (suspension) of the granulated monomer composition was placed into a reaction vessel equipped with an agitation blade, and heated to 90° C. to start polymerization reaction. After keeping the polymerization reaction to proceed for 10 hours, the reaction was terminated by water cooling.

Next, filtration, washing, and drying were conducted in the same manner as in Example 1, preparing toner base particles of Example 10.

EXAMPLE 11

Toner was produced by the dissolution/suspension method (emulsification/dispersion method) in accordance with Example 1 of JP-A No. 11-52619.

After mixing 1,243 parts of terephthalic acid, 1830 parts of bisphenol A ethyleneoxide adduct and 840 parts of bisphenol A propyleneoxide adduct at 180° C. while heating, 3 parts of dibutyltinoxide was added and water removed while heating at 220° C., whereby a polyester was obtained. To this polyester was added 1,500 parts of cyclohexanone and dissolved, and 250 parts of acetic anhydride was added and heat at 130° C. Next, the solvent and unreacted acid were removed by heating under reduced pressure, preparing a polyester resin.

The obtained polyester resin had a glass transition temperature (Tg) 60° C., acid number of 3 mg KOH/g, and hydroxyl value of 1 mg KOH/g.

Subsequently, 100 parts of the foregoing polyester resin and 4 parts of C.I. pigment blue 15:3 were dispersed in 110 parts of ethyl acetate for 48 hours with a ball mill (the resultant solution was termed "Solution A").

Meanwhile, 10 parts of the fine particle dispersion prepared in Example 1, 10 parts of the polyethyleneglycol dibehenate No. 1 (weight average molecular weight=20,000, melting point=66° C., and the number of carbon atoms in the aliphatic acid (R)=22), and 100 parts of 2% by mass aqueous solution of carboxymethyl cellulose (Product name "Cellogen BS-H", a product of Dai Ichi Kogyo Seiyaku Co., Ltd) were mixed (the resultant solution was termed "Solution B").

Next, 100 parts of Solution B was agitated with an emulsifying device (Product name "Auto Homogenizing Mixer", manufactured by Tokushu Kika Kogyo Co., Ltd), and 50 parts of Solution A was slowly added to Solution B, suspending the resultant mixture. Subsequently, the solvent was removed under reduced pressure. Next, 100 parts of 6N hydrochloric acid was added to remove calcium carbonate. Furthermore washing was performed with water, followed by drying. In this way toner base particles of Example 11 were produced.

EXAMPLE 12

Toner base particles of Example 12 were produced in the same manner as in Example 1 except that 10 parts of polyethylene glycol dibehenate No. 1 was added upon preparation of solution/dispersion of toner materials rather than preparation of aqueous medium phase.

EXAMPLE 13

Toner base particles of Example 13 were produced in the same manner as in Example 1 except that in the preparation of fine resin particles, the rotation speed of blade for agitation was changed to 100 rpm, and that the resultant fine resin particle dispersion was used for the preparation of aqueous medium phase. The volume average particle size of the fine resin particles, as measured in the same manner as described in Example 1, was 520 nm.

COMPARATIVE EXAMPLE 1

Toner base particles of Comparative Example 1 were produced in the same manner as in Example 1 except that in the preparation of aqueous medium phase, polyethylene glycol dibehenate No. 1 was not added.

COMPARATIVE EXAMPLE 2

Toner base particles of Comparative Example 2 were produced in the same manner as in Example 1 except that in the preparation of aqueous medium phase, polyethyleneglycol dibehenate No. 1 was not added, and that the added amount of fine resin particle dispersion was doubled (120 parts).

COMPARATIVE EXAMPLE 3

Toner base particles of Comparative Example 3 were produced in the same manner as in Example 1 except that in the preparation of aqueous medium phase, the resin fine particle dispersion was not added.

COMPARATIVE EXAMPLE 4

Toner base particles of Comparative Example 4 were produced in the same manner as in Example 1 except that in the preparation of aqueous medium phase, the polyethyleneglycol dibehenate No. 1 wash changed to polyethylene glycol dibehenate No. 4 (weight average molecular weight=1,700, melting point=48° C.).

COMPARATIVE EXAMPLE 5

Toner base particles of Comparative Example 5 were produced in the same manner as in Example 1 except that in the preparation of aqueous medium phase, the polyethyleneglycol dibehenate No. 1 was changed to non-esterified polyethyleneglycol (PEG, weight average molecular weight=20,000).

-External Additive Treatment-

Using Henschel mixer (manufactured by Mitsuikozan Co., Ltd), as an external additive, 1.0 part of hydrophobic silica ("H2000", manufactured by Clariant Japan) was mixed with 100 parts of each of the toner base particles of Examples 1 to 13 and Comparative Examples 1 to 5. Upon mixing, 5 cycles of 30-second mixing at a circumferential rate of 30 m/s followed by 1 min-pausing were carried out, and the resulting mixture was passed through a 35 μm mesh sieve. In this way toners of Examples 1 to 13 and Comparative Examples 1 to 5 were prepared.

Table 1 summaries the identities and added amounts of PAG ester and fine resin particles for the toners of Examples 1 to 13 and Comparative Examples 1 to 5. Furthermore, ΔT, a measure indicative of the compatibility between fine resin particles and PAG ester, the weight average molecular weight of PAG ester, and the melting point of PAG ester were measured in the manner described below. The measurements are shown in Table 1.

<Method for Determination of the Compatibility Between PAG Ester and Fine Resin Particles>

The state in which fine resin particles and PAG ester (PEG in Comparative Example 5) are mutually dissolved was measured as follows. First of all, fine resin particles and PAG ester were mixed in proportions of 1:1 (mass basis), and after pulverization with a mortar, the mixture was passed through 100 μm mesh to prepare a PAG ester/fine resin particle mixture.

Measurements were made for the obtained PAG ester/fine resin particle mixture and a PAG ester alone, using a DSC system (differential scanning calorimeter) ("DSC-60" manufactured by Shimadzu Seisakujo) as follows.

Firstly, 5.0 mg of PAG ester alone was placed into an aluminum sample container, the container was mounted to a holder unit, and the holder unit was placed in an electric furnace. Next, in a nitrogen atmosphere, the furnace temperature was raised from 20° C. to 150° C. in increments of 10° C./min, followed by cooling to 0° C. in increments of 10° C./min. Subsequently, the temperature was again raised to 150° C. in increments of 10° C./min, obtaining DSC curves. An analysis program of the DSC-60 system was then used to obtain a PAG ester-derived peak from the DSC curve obtained by the 2nd temperature increase, and the PAG ester's melting point Tm1 was obtained from the peak value. Next, the same measurement was performed for the mixture of PAG ester and fine resin particles; the mixture's melting point Tm2 was obtained from the value of the PAG ester-derived peak from the mixture's 2nd temperature increase. Tm1−Tm2 was defined as ΔT. Where ΔT was 1° C. or greater, the PAG ester's melting point was dropped by mutually dissolving with the fine resin particles at the time of the 1st temperature increase.

<Measurement of PAG Ester's Weight Average Molecular Weight>

The weight average molecular weight was measured by gel permeation chromatography (GPC), as will be described hereinafter.

Firstly, in order to isolate the polyalkylene glycol ester compound contained in the toner, a solvent that dissolves polyalkylene glycol ester compounds but not toner resins and waxes, e.g., a high polar solvent such as water, an alcohol like methanol or ethanol, or acetone was employed. The toner was added in such a solvent and stirred at around 60° C., the liquid component was separated by filtration or the like, and the resultant PAG ester extract liquid was dried to obtain the polyalkylene glycol ester compound in the toner.

Next, a column was equilibrated in a 40° C. heat chamber, and at this temperature, a column solvent was passed through the column at a flow rate of 1 ml/min. Subsequently, a sample solution containing 0.05-0.6% by mass polyalkylene glycol ester compound in column solvent was prepared, and 50 μl to 200 μl of sample solution was passed through the column for measurement.

The molecular weight of the test sample was calculated from relationship between the logarithm values and counts in the calibration curve (standard curve) prepared from standard polyethylene glycols with different molecular weights. As the standard polyethylene glycols used for the preparation of the calibration curve (standard curve), polyethylene glycols with 400, 600, 1000, 2000, 4000, 6000, 10000, and 200000 molecular weights (Sanyo Kasei Co., Ltd.) were employed. And, an RI (refractive index) detector was employed for the detector.

TABLE 1

| | PAG ester | | | | | | |
|---|---|---|---|---|---|---|---|
| | Composition | Added amount (relative to toner mass) | Tm (° C.) | Weight average molecular weight | Number of carbon chains in Fatty acid (R) | Fine Resin particle Content of toner | Compatibility Δ T (° C.) |
| Example 1 | PEG dibehenate No. 1 | 10 mass % | 66 | 20,000 | 22 | 2.0 mass % | 3 |
| Example 2 | PEG dibehenate No. 1 | 10 mass % | 52 | 2,500 | 22 | 2.0 mass % | 6 |
| Example 3 | PEG dibehenate No. 1 | 10 mass % | 60 | 8,000 | 22 | 4.0 mass % | 4 |
| Example 4 | PEG dibehenate No. 1 | 15 mass % | 66 | 20,000 | 22 | 4.0 mass % | 3 |
| Example 5 | PEG dilaurate | 10 mass % | 64 | 20,000 | 12 | 2.0 mass % | 4 |
| Example 6 | PEG dicaprylate | 10 mass % | 62 | 20,000 | 8 | 2.0 mass % | 2 |
| Example 7 | PEG dibehenate No. 1 | 3 mass % | 66 | 20,000 | 22 | 2.0 mass % | 3 |
| Example 8 | PEG dibehenate No. 1 | 5 mass % | 66 | 20,000 | 22 | 0.3 mass % | 3 |
| Example 9 | PEG dibehenate No. 1 | 10 mass % | 66 | 20,000 | 22 | 2.0 mass % | 3 |
| Example 10 | PEG dibehenate No. 1 | 10 mass % | 66 | 20,000 | 22 | 2.0 mass % | 3 |
| Example 11 | PEG dibehenate No. 1 | 10 mass % | 66 | 20,000 | 22 | 2.0 mass % | 3 |
| Example 12 | PEG dibehenate No. 1 | 10 mass % | 66 | 20,000 | 22 | 2.0 mass % | 3 |
| Example 13 | PEG dibehenate No. 1 | 10 mass % | 66 | 20,000 | 22 | 2.0 mass % | 3 |
| Comparative Ex. 1 | None | — | — | — | — | 2.0 mass % | — |
| Comparative Ex. 2 | None | — | — | — | — | 4.0 mass % | — |
| Comparative Ex. 3 | PEG dibehenate No. 1 | 10 mass % | 66 | 20000 | 22 | — | — |
| Comparative Ex. 4 | PEG dibehenate No. 4 | 10 mass % | 48 | 1700 | 22 | 2.0 mass % | 0.5 |
| Comparative Ex. 5 | PEG | 10 mass % | 62 | 20000 | — | 2.0 mass % | 0 |

<Measurement of Toner's Volume Average Particle Size and Particle Size Distribution>

The toner's volume average particle size (Dv) and number average particle size (Dn) were measured using a particle size analyzer ("Multisizer III", Beckman Coulter) with an aperture diameter of 100 μm, using analysis software (Beckman Coulter Mutlisizer 3 Version 3.51).

Specifically, 0.5 ml of 10% by mass surfactant (alkylbenzenesulfonic acid salt neogen SC-A, manufactured by Dai Ichi Kogyo Seiyaku Co., Ltd) was placed in a 100 ml glass beaker and 0.5 g of each toner was added therein, mixed with a micro-spatula, and then 80 ml of ion-exchanged water was added. The obtained dispersion was processed for 10 minutes with an ultra-sonicator (W-113MK-II, manufactured by Honda Electronics Co., Ltd.). The obtained dispersion was analyzed using Multisizer III, and Isotone III (Beckman Coulter) was used as a measurement solution. The toner sample dispersion was added dropwise to the measurement device such that its concentration read by the device is 8±2%. It is important in this measurement method that the sample concentration be 8±12% to ensure reproducibility of the particle diameter measurement. No measurement variations will occur with respect to particle size when the concentration falls within the above range.

<Measurement of Toner's Glass Transition Temperature>

The toner's glass transition temperature was measured with the following method using TG-DSC system TAS-100 (Rigaku Electric Instrument Co., Ltd.).

Firstly, 10 mg of toner was placed into an aluminum test sample container, the test sample container was mounted to a holder, and the holder was placed in an electric furnace. After increasing the temperature from room temperature to 150° C. in increments of 10° C./min, the sample was allowed to stand at 150° C. for 10 minutes, cooled to room temperature, and again allowed to stand for 10 minutes. Subsequently, in a nitrogen atmosphere, the temperature was increased to 150° C. in increments of 10° C./min, and a DSC curve was measured by a differential scanning calorimeter (DSC). Using the analysis system of the TG-DSC System TAS-100 system, the glass transition temperature (Tg) was found from the contact point between the tangent line of the endotherm curve near the transition temperature (Tg) and the baseline.

-Preparation of Carrier-

A coating solution for coated layer was prepared by adding 100 parts of silicone resin ("organostraight silicone"), 5 parts of γ-(2-amino ethyl)aminopropyltri-methoxysilane, and 10 parts of carbon black to 100 parts of toluene, and dispersing the ingredients for 20 minutes with a homogenizing mixer. Using a fluid bed type coater, the coating solution was applied over the surface of spherical magnetite particles (1000 parts) of 5 μm diameter, whereby a magnetic carrier was prepared.

-Preparation of Developer-

Five parts of each of the external additive-treated toners of Examples 1 to 13 and Comparative Examples 1 to 5 and 95 parts of the foregoing carrier were mixed in a ball mill, preparing two-component developers of Examples 1 to 13 and Comparative Examples 1 to 5.

The obtained developers were evaluated for fixation characteristics (offset generation temperature and lowest fixing temperature), and heat-resistance/storage stability in the manner described below. The results are shown in Table 2.

<Fixation Characteristic (Offset Generation Temperature and Lowest Fixing Temperature)>

From the fixing unit of a tandem color image forming apparatus ("Imagio Neo C350" Ricoh company), the silicone oil coating mechanism was removed to employ an oil-less fixing format, the apparatus being configured to capable of temperature and linear velocity adjustment. And, plain paper ("TYPE 6000<70W>Y", manufactured by Ricoh Company) was employed, Using the above image forming apparatus and paper, evaluation was made for fixation characteristics (offset non-generation temperature and lowest fixing temperature).

Note that the tandem color image forming apparatus is capable of printing 35 copies of A4 size paper per minute. Evaluations were conducted at the linear velocity of the fixation rollers of 125 mm/s for different roller temperatures.

-Offset Generation Temperature-

Image formation was performed on the tandem color electrophotographic apparatus described above. Development of one-color solid images (yellow, magenta, cyan, and black) was so adjusted that the corresponding color toner is spent in an amount of 0.85±0.3 mg/cm$^2$. The obtained images were fixed to paper at various fixation roll temperatures to determine the temperature at which hot offset occurs, i.e., offset generation temperature, and evaluations were made based on the following criteria

[Evaluation Criteria]

A: equal to or greater than 210° C.

B: less than 210° C. and equal to or greater than 190° C.

C: less than 190° C. and equal to or greater than 170° C.

D: less than 170° C.

-Lowest Fixing Temperature-

Copying tests were conducted for the above images using the tandem color electrophotographic apparatus loaded with the plain paper. The lowest fixing temperature was defined as the temperature at which 70% or greater of image density was remained on the fixed image after rubbing it with a special cloth pat. Evaluations were conducted based on the following criteria.

[Evaluation Criteria]

A: less than 110° C.

B: less than 130° C. and equal to or greater than 110° C.

C: less than 150° C. and equal to or greater than 130° C.

D: equal to or greater than 150° C.

<Heat-resistance/storage Stability (Penetration)>

Each toner was loaded into a 50 ml glass container, and allowed to stand at 50° C. in a constant temperature bath for 24 hours. The toner was cooled to 24° C., and a penetration test (JIS K2235-1991) was performed by measuring the penetration (expressed in millimeter), and evaluations were conducted based on the following criteria. Note that higher values of penetration mean superior heat-resistance/storage stability; if the penetration is 5 mm or less, there is a high possibility of problems during usage.

[Evaluation Criteria]

A: penetration is 25 mm or greater

B: penetration is 15 mm or greater and less than 25 mm

C: penetration is less than 15 mm

TABLE 2

| | Physical properties of toner | | | Fixation property | | Heat |
|---|---|---|---|---|---|---|
| | Dv(μm) | Dv/Dn | Glass Transition Temperature (° C.) | Lowest fixing temperature | Hot Offset | Resistance/ storage stability |
| Example 1 | 6.2 | 1.1 | 60 | A | B | A |
| Example 2 | 5.7 | 1.2 | 58 | A | B | A |
| Example 3 | 5.4 | 1.1 | 59 | B | B | A |
| Example 4 | 5.4 | 1.1 | 60 | A | B | A |
| Example 5 | 5.6 | 1.2 | 58 | A | B | A |
| Example 6 | 5.8 | 1.2 | 61 | B | B | A |
| Example 7 | 5.5 | 1.1 | 60 | B | B | A |
| Example 8 | 6.8 | 1.3 | 60 | A | B | A |
| Example 9 | 52 | 1.1 | 60 | A | A | A |
| Example 10 | 5.5 | 1.2 | 60 | B | B | A |
| Example 11 | 5.5 | 1.1 | 65 | B | B | A |

TABLE 2-continued

| | Physical properties of toner | | | Fixation property | | Heat |
|---|---|---|---|---|---|---|
| | Dv(μm) | Dv/Dn | Glass Transition Temperature (° C.) | Lowest fixing temperature | Hot Offset | Resistance/ storage stability |
| Example 12 | 5.3 | 1.1 | 60 | B | B | A |
| Example 13 | 5.8 | 1.3 | 60 | A | B | A |
| Comparative Example 1 | 5.8 | 1.2 | 60 | C | B | A |
| Comparative Example 2 | 5.6 | 1.1 | 62 | D | B | A |
| Comparative Example 3 | 10.8 | 2.1 | 58 | B | B | C |
| Comparative Example 4 | 7.2 | 1.4 | 60 | C | C | C |
| Comparative Example 5 | 6.3 | 1.2 | 60 | D | B | A |

The results of Tables 1 and 2 show that Examples 1 to 9 offered excellent fixation property and heat-resistance/storage stability as a result of using PAG esters that are compatible with fine resin particles and that have weight average molecular weights of 2,000 or greater. Similarly, excellent results were obtained both in Examples 10 and 11, where suspension polymerization method and dissolution suspension method were used, respectively.

In Examples 1 to 7 and 9, appropriate amounts of added fine resin particles led to increased toner particle stability upon toner preparation, enabling production of toners with excellent particle diameters and particle size distributions. It can be easily deduced that these toners can provide excellent image quality, though no image quality evaluations were made this time.

In Example 8, since the amount of added fine resin particles was small, there was a tendency that the particle size distribution somewhat broadened although excellent fixation property was ensured.

In Examples 3 and 4 where the added amount of fine resin particles was greater, sufficient toner particle stability upon toner preparation led to more uniform particle size distributions.

In particular, in Examples 1, 2 and 5, where greater compatibility was seen between fine resin particles and PAG ester, and in Example 4 where an appropriate amount of PAG ester was used, it succeeded in obtaining excellent fixation property.

In Example 9, the use of a paraffin wax, hydrocarbon wax, led to obtaining good fixation property as well as improved hot offset characteristics.

In Example 6, since the number of aliphatic acid carbon chain was as small as 8, the compatibility between PAG ester and fine resin particles was reduced and thus surface action lowers; therefore, the effect of improving low temperature fixation property was slightly reduced.

In Example 7, since the added amount PAG ester was as small as 3% by mass, there was a slight reduction in the effect of improving low temperature fixation property.

In Example 12, since PAG ester was added in the solution or dispersion of toner materials rather than in the aqueous medium phase, the action of the PAG ester exerting on fine resin particles was affected by other ingredients contained in the toner materials dispersion; therefore, there was a slight reduction in the effect of improving low temperature fixation property.

In Example 13, since the fine resin particles were slightly coarse (volume average particle size of 520 nm, there was a tendency that the particle size distribution was slightly poor, although the fixation property was excellent.

In the toner of Comparative Example 1, by contrast, since no PAG ester was added, it resulted in failure to obtain excellent fixing property due to attachment of high-molecular fine resin particles to the toner particle surface, which excellent fixing property was deemed to be attained by the use of the polyester resin of the present invention.

Also in Comparative Example 2, sufficient fixation property was not obtained, and furthermore, the increased added amount of fine resin particles led to poor fixation property.

In Comparative Example 3, since fine resin particles, which have a function of increasing particle stability upon toner granulation with the toner production method of the present invention, were not added, coarse and irregularly-shaped particles resulted. Hence, it can easily be deduced that high image quality will not be obtained through the use of this toner.

In Comparative Example 4, since the weight average molecular weight of the added PAG ester was low, it resulted in improper surface action on the fine resin particles present on the toner particle surface; therefore, sufficient low temperature fixation property was not exerted. In addition, the particle diameter was slightly increased, leading to poor particle size distribution.

In Comparative Example 5, non esterified PEG was added in place of PAG ester and thus offered no compatibility with fine resin particles; therefore, it resulted in failure to obtain excellent low temperature fixation property.

The toner of the present invention has good fluidity and fixation characteristics, and since the low temperature fixation characteristics co-exist with heat-resistance/storage stability it can be appropriately used in high quality image formation. The image forming apparatus and method using a developer which uses the toner of the present invention, a toner container, and a process cartridge used in the present invention are suitably used for the formation of high-quality images.

What is claimed is:

1. A toner prepared by emulsifying or dispersing a solution or dispersion of a toner material in an aqueous medium containing fine resin particles for granulation, wherein at least one of the toner material and the aqueous medium contains a polyalkylene glycol ester compound that is compatible with the fine resin particles and that has a weight average molecular weight of 2,000 or greater and is 5% by mass or higher based on the total mass of the toner.

2. The toner according to claim 1, wherein the aqueous medium contains a polyalkylene glycol ester compound that is compatible with the fine resin particles and that has a weight average molecular weight of 2,000 or greater.

3. The toner according to claim 1, wherein the solution or dispersion of the toner material contains an organic solvent, and the organic solvent is removed during or after the granulation.

4. The toner according to claim 1, wherein the toner material contains an active hydrogen group-containing compound and a polymer reactive with the active hydrogen group-containing compound, and wherein the granulation is conducted by reacting the active hydrogen group-containing compound with the polymer in the aqueous medium to produce an adhesive base, to obtain particles of the adhesive base.

5. The toner according to claim 1, wherein the polyalkylene glycol ester compound is an esterified product of a carboxylic acid having the following General Formula (1) and a polyalkylene glycol having the following General Formula (2):

$$R—COOH \qquad \text{<General Formula (1)>}$$

where R is an alkyl group having 10 or more carbon atoms; and $$HO—[(CH_2)_n—]_m—OH \qquad \text{<General formula (2)>}$$

where n and m each represent an integer of 2 or greater.

6. The toner according to claim 1, wherein the polyalkylene glycol ester compound has a melting point of 40° C. or higher.

7. The toner according to claim 1, wherein the fine resin particles have a volume average particle diameter of 5 nm to 500 nm.

8. The toner according to claim 1, wherein the content of the fine resin particles in the toner is 0.5% by mass or higher.

9. The toner according to claim 1, wherein the toner material contains a wax, and the wax contains a hydrocarbon wax having a melting point of 50° C. or higher.

10. The toner according to claim 1, wherein the toner has a glass transition temperature (Tg) of 50° C. to 80° C.

11. The toner according to claim 1, wherein the toner has a volume average particle size (Dv) of 3 μm to 8 μm, and the ratio of the volume average particle diameter (Dv) to the number average particle diameter (Dn), (Dv/Dn), is 1.00 to 1.25.

12. A method for producing a toner, comprising:

dissolving or dispersing a toner material to prepare a solution or dispersion of the toner material; and emulsifying or dispersing the solution or dispersion of the toner material in an aqueous medium containing fine resin particles for granulation, wherein at least one of the toner material and the aqueous medium contains a polyalkylene glycol ester compound that is compatible with the fine resin particles and that has a weight average molecular weight of 2,000 or higher and is 5% by mass or higher based on the total mass of the toner.

13. The method according to claim 12, wherein the solution or dispersion of the toner material contains an organic solvent, and the organic solvent is removed during or after the granulation.

14. The method according to claim 12, wherein the toner material contains an active hydrogen group-containing compound and a polymer reactive with the active hydrogen group-containing compound, and wherein the granulation is conducted by reacting the active hydrogen group-containing compound with the polymer in the aqueous medium to produce an adhesive base, to obtain particles of the adhesive base.

15. A developer comprising:

a toner prepared by emulsifying or dispersing a solution or dispersion of a toner material in an aqueous medium containing fine resin particles for granulation, wherein at least one of the toner material and the aqueous medium contains a polyalkylene glycol ester compound that is compatible with the fine resin particles and that has a weight average molecular weight of 2,000 or greater and is 5% by mass or higher based on the total mass of the toner.

* * * * *